US007753797B2

(12) United States Patent
Walker et al.

(10) Patent No.: US 7,753,797 B2
(45) Date of Patent: Jul. 13, 2010

(54) SECURITY METHODS AND APPARATUS FOR A TANGIBLE MEDIUM CONTAINING WAGERING GAME OUTCOMES

(75) Inventors: Jay S. Walker, Ridgefield, CT (US); Daniel E. Tedesco, Shelton, CT (US); James A. Jorasch, New York, NY (US); Russell P. Sammon, San Francisco, CA (US)

(73) Assignee: IGT, Reno, NV (US)

( * ) Notice: Subject to any disclaimer, the term of this patent is extended or adjusted under 35 U.S.C. 154(b) by 85 days.

(21) Appl. No.: 11/384,124

(22) Filed: Mar. 17, 2006

(65) Prior Publication Data

US 2006/0246984 A1 Nov. 2, 2006

Related U.S. Application Data

(60) Provisional application No. 60/663,545, filed on Mar. 18, 2005, provisional application No. 60/685,604, filed on May 27, 2005, provisional application No. 60/666,393, filed on Mar. 29, 2005.

(51) Int. Cl.
*A63F 9/24* (2006.01)

(52) U.S. Cl. ..... 463/43; 463/17; 463/29; 463/46

(58) Field of Classification Search ..... 463/29, 463/1, 20, 17, 43, 46
See application file for complete search history.

(56) References Cited

U.S. PATENT DOCUMENTS 5,178,389 A 1/1993 Bentley et al. ..... 273/138 A
5,613,680 A * 3/1997 Groves et al. ..... 273/138.2
5,709,603 A * 1/1998 Kaye ..... 463/17
5,791,990 A * 8/1998 Schroeder et al. ..... 463/17
5,800,268 A 9/1998 Molnick
5,935,673 A 8/1999 Mueller ..... 428/64.1
6,011,772 A 1/2000 Rollhaus et al. ..... 369/286
6,087,075 A * 7/2000 Kler et al. ..... 430/321
6,508,709 B1 1/2003 Karmarkar ..... 463/42
6,645,075 B1 11/2003 Gatto et al. ..... 463/25
6,709,331 B2 3/2004 Berman ..... 463/16

(Continued)

OTHER PUBLICATIONS

Flexplay product packaging: "Flexplay—Reinventing the Rental—the 48 hour, no-return DVD", undated.

(Continued)

*Primary Examiner*—Peter DungBa Vo
*Assistant Examiner*—Omkar Deodhar
(74) *Attorney, Agent, or Firm*—K&L Gates LLP

(57) ABSTRACT

In accordance with some embodiments, a plurality of outcomes are generated and used to create a video presentation of representative outcomes that is recorded onto a tangible medium (e.g., DVD or CD-ROM). A player may then purchase a video presentation of (e.g., predetermined) outcomes in a jurisdiction in which gambling is legal and then view the presentation at the player's convenience (e.g., from any jurisdiction and at any time). In some embodiments, a salesperson inspects at least one tamper evident item associated with the tangible medium for any indication of tampering. If no tampering is evident, then the salesperson activates the tangible medium upon receipt of a purchase price. In some embodiments, if the salesperson determines that tampering has occurred, then she refuses to activate the tangible medium, and information about the player and the tangible medium may be communicated to one or more databases.

4 Claims, 21 Drawing Sheets

U.S. PATENT DOCUMENTS

| | | | | |
|---|---|---|---|---|
| 6,780,564 | B2 | 8/2004 | Lawandy et al. | 430/270.1 |
| 6,863,608 | B1 | 3/2005 | LeMay et al. | 463/24 |
| 6,918,831 | B2 | 7/2005 | Nguyen et al. | 463/20 |
| 6,935,949 | B1 | 8/2005 | Murphy | 463/20 |
| 6,964,609 | B2 | 11/2005 | Haag et al. | 463/20 |
| 6,987,925 | B2 | 1/2006 | Kinzer et al. | 386/69 |
| 7,056,824 | B2 * | 6/2006 | Mirth | 438/623 |
| 7,198,571 | B2 * | 4/2007 | LeMay et al. | 463/25 |
| 2002/0180588 | A1 * | 12/2002 | Erickson et al. | 340/10.2 |
| 2003/0070338 | A1 * | 4/2003 | Roshkoff | 40/638 |
| 2003/0172618 | A1 * | 9/2003 | Mueller | 53/284.5 |
| 2004/0066296 | A1 * | 4/2004 | Atherton | 340/572.1 |
| 2004/0124243 | A1 * | 7/2004 | Gatto et al. | 235/487 |
| 2004/0152504 | A1 | 8/2004 | Herrmann et al. | 463/16 |
| 2004/0229677 | A1 | 11/2004 | Gray et al. | 463/17 |
| 2004/0235550 | A1 | 11/2004 | McNally et al. | 463/16 |
| 2005/0037181 | A1 | 2/2005 | Lawandy | 428/204 |
| 2005/0045503 | A1 * | 3/2005 | Wong et al. | 206/308.2 |
| 2005/0053373 | A1 * | 3/2005 | Ueyama et al. | 396/513 |
| 2005/0058800 | A1 | 3/2005 | Lawandy et al. | 428/64.4 |
| 2005/0059493 | A1 | 3/2005 | Tyson et al. | 463/42 |
| 2005/0114272 | A1 | 5/2005 | Herrmann et al. | 705/67 |
| 2005/0119042 | A1 | 6/2005 | Chamberlain et al. | 463/19 |
| 2005/0170881 | A1 | 8/2005 | Muskin | 463/20 |
| 2005/0193209 | A1 | 9/2005 | Saunders et al. | 713/182 |
| 2005/0255905 | A1 * | 11/2005 | Duke et al. | 463/17 |
| 2005/0277459 | A1 | 12/2005 | Haag et al. | 463/13 |

OTHER PUBLICATIONS

Press Release: "New Product, Facility & Safety Identification—Introducing B7566 Tamper Indicating Label Material", Brady, Aug. 9, 2004, Retrieved from the Internet: <http://www.bradyaust.com.au>.

"Soanar—571AJ—Tamper evident polyester label", [online], [retrieved Mar. 18, 2005], Retrieved from the Internet: <http://www.ferret.com.au/articles/00/0c025600.asp>.

"Static Cling Decals", [online], [retrieved Mar. 18, 2005], Retrieved from the Internet: <http://www.janway.com/static-decals.html>.

"Transportation Loss Prevention Products-Security Tape", Switched On [online], [retrieved Mar. 18, 2005], Retrieved from the Internet: <http://www.switchedon.com.au/Secure.html>.

"Static Cling Decals, Window Decals, Removable Window Decals", [online], [retrieved Mar. 18, 2005], Retrieved from the Internet: <http.//www.buypromoitems.com/static_decals.htm>.

"How Flexplay Works", Flexplay [online], [retrieved Mar. 18, 2005], Retrieved from the Internet: <http://www.flexplay.com/how-flexplay-works.htm>.

"Bar Code Symbologies Overview", Data Identification [online], [retrieved Mar. 18, 2005], Retrieved from the Internet: <http://www.dataid.com/bcsymbology.htm>.

Bonsor, Kevin, "How RFIDs Work", How Stuff Works [online], [retrieved Mar. 18, 2005], Retrieved from the Internet: <http://www.electronics.howstuffworks.com/smart-label.htm/printable>.

"Security Labels and Security Seals", securitylabels.com [online], [retrieved Mar. 21, 2005], Retrieved from the Internet: <http://www.securitylables.com/features.htm>.

"Low residue adhesives", securitylabels.com [online], [retrieved Mar. 21, 2005], Retrieved from the Internet: <http://www.securitylables.com/low_residue_adhesives.htm>.

"self voiding", securitylabels.com [online], [retrieved Mar. 21, 2005], Retrieved from the Internet: <http://www.securitylables.com/self_voiding.htm>.

"Tamper evident RFID labels", securitylabels.com [online], [retrieved Mar. 21, 2005], Retrieved from the Internet: <http://www.securitylables.com/RFID_labels.htm>.

"Kansas Lottery presents eScratch", [online], [retrieved Jun. 8, 2005], Retrieved from the Internet: <http://www.escratchks.com/escratch/postHome.do>.

"How Flexplay Works", Flexplay [online], [retrieved Feb. 8, 2006], Retrieved from the Internet: <http://www.flexplay.com/how-flexplay-works.htm>.

"DVD/CD Sealing", securitylabels.com [online], [retrieved Mar. 16, 2006], Retrieved from the Internet: <http://www.securitylables.com/dvd_cd_sealing.htm>.

"Tamper Evident Security Tape Options", Advantage Information Products [online], [retrieved Mar. 16, 2006], Retrieved from the Internet: <http://www.rightertrack.com/securitytape.htm>.

"Tamper Evident Seals and Shrink Bands from Seal-It, Inc.", Seal-It, Inc. [online], [retrieved Mar. 16, 2006], Retrieved from the Internet: <http://www.sealitinc.com/profile/tamper.as>.

"Stock Compact Disk Protection/Storage", [online], [retrieved Mar. 16, 2006], Retrieved from the Internet: <http://www.bcwdiv.com/scompact.htm>.

"Customizable Tamper Evident Holographic 'Dog Bone' Seal", [online], [retrieved Mar. 16, 2006], Retrieved from the Internet: <http://www.securityhologram.com/index.php?action=buy&id=51>.

Brochure: "Unlock the power of DVD with Optreve", www.screenlifedve.com, undated.

Overview: "DVD Manufacturing Process", Technicolor, a Thomson Service, undated.

Press Release: "Correction—Legal iGaming—LV NV", PR Newswire, Apr. 4, 2004.

Nice, Karim, "How DVDs Work", [online], [retrieved Apr. 8, 2005], Retrieved from the Internet: <http://electronics.howstuffworks.com/dvd.htm/printable>.

McQueen, Patricia A., "New game in town—Electronic Game Card hopes gaming and promotional innovation leads to casino and lottery inroads", Casino Journal, May 2005, pp. 40,42 and 50.

"DVD 8800S", [online], [retrieved May 24, 2005], Retrieved from the Internet: <http://www.convactech.com/product/dvd8800mid.html>.

"Welcome to the Future of Gaming . . . ", Legal iGaming, [online], [retrieved Jun. 13, 2005], Retrieved from the Internet: <http://www.legaligaming.com/main.htm>.

"Quarter Play: The Instant-Scratch Game Goes Electronic", Iowa Lottery Press Room, [online], [retrieved Jun. 13, 2005], Retrieved from the Internet: <http://www.ialottery.com/PressRoom/N10-01-04.html>.

"Remote Access Gaming", Legal iGaming, [online], [retrieved Jun. 13, 2005], Retrieved from the Internet: <http://www.legaligaming.com/remote.htm>.

Welch, Sara, "Foxwood's new Playway game stirs up controversy", WTNH.com, [online], [retrieved Jul. 20, 2005], Retrieved from the Internet: <http://www.wtnh.com/Global/story.asp?S=3615729>.

* cited by examiner

500

| | DISC IDENTIFIER 505 | PAYOUT 510 | PRICE 515 | DATE SOLD 520 | ACTIVATION CODE 525 | PLAYER IDENTIFIER 530 | STATUS 535 |
|---|---|---|---|---|---|---|---|
| R500-1 | D-1003210-87912487 | $15.00 | $20.00 | 1/6/06 12:22 PM | XY90-ZF42-9962-0651 | N/A | PURCHASED |
| R500-2 | D-1003210-87912487 | $18.00 | $20.00 | 1/6/06 12:38 PM | Z410-9124-BC21-EG3X | P-10421087 | PURCHASED |
| R500-3 | D-891266-101421011 | $0.00 | $25.00 | 1/6/06 12:40 PM | BB12-4XQ2-GF33-47WY | P-71032109 | PURCHASED |
| R500-4 | D-001247-891333415 | $72.50 | $25.00 | 1/6/06 12:56 PM | XXF9-417B-GAB3-DY06 | P-71032100 | REDEEMED |
| R500-5 | D-771043-213412879 | $72.50 | $20.00 | -- | -- | -- | AVAILABLE |

FIG. 5

950

DiscPlay

*SLOTS*

*Watch Slots Anywhere on DVD - and WIN!*

- FULL CASINO ODDS
- FULL CASINO PAYOUTS
- $10,000,000 SUPER JACKPOT

960

1 ACTIVATE THE DVD...
ACTIVATE THE ENCLOSED DVD AT ANY CASHIER.
WE'LL GIVE YOU A COMPUTERIZED RECEIPT.
KEEP THE RECEIPT WITH THE DISC...

2 WATCH IT ANYWHERE...
PLAY YOUR SLOT DISC ON ANY TV
OR PC WITH A DVD PLAYER.
EACH DISC 30-60 MINUTES OF
REAL SLOT ACTION!

3 COLLECT ANY WINNINGS!
IF YOU WIN, SIMPLY RETURN YOUR DVD WITH
YOUR COMPUTERIZED RECEIPT TO ANY CASINO
CASHIER.
YOU HAVE UP TO ONE YEAR TO CLAIM YOUR
WINNINGS.

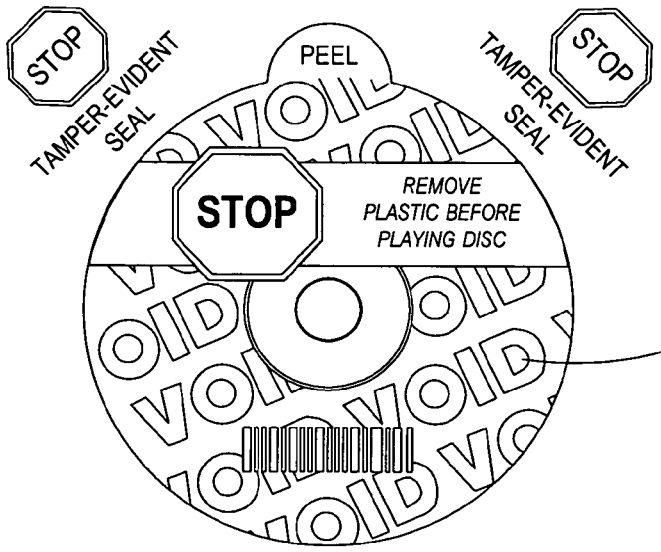

955

*DVD IS VOID UNTIL ACTIVATED BY CASINO*

FIG. 9C

1320

GAME RESULTS TICKET

CASINO XYZ

RESULTS TICKET 1

CONTRACT # GC-01927

| | | | | |
|---|---|---|---|---|
| 01 LE-LE-CH +10 | XX LE-LE-CH +10 | XX LE-LE-CH +10 | XX BR-LE-BL +0 | XX BR-LE-BL +0 |
| 02 BR-LE-BL +0 | XX BR-LE-BL +0 | XX BR-LE-BL +0 | XX BR-LE-BL +0 | XX BR-LE-BL +0 |
| 03 LE-LE-CH +10 | XX LE-LE-CH +10 | XX BR-LE-BL +0 | XX LE-LE-CH +10 | XX LE-LE-CH +10 |
| 04 BR-LE-BL +0 | XX BR-LE-BL +0 | XX BR-LE-BL +0 | XX BR-LE-BL +0 | XX BR-LE-BL +0 |
| XX LE-LE-CH +10 | XX BR-LE-BL +0 | XX BR-LE-BL +0 | XX BR-LE-BL +0 | XX BR-LE-BL +0 |
| XX BR-LE-BL +0 | XX BR-LE-BL +0 | XX BR-LE-BL +0 | XX BR-LE-BL +0 | XX BR-LE-BL +0 |
| XX BR-LE-BL +0 | XX BR-LE-BL +0 | XX LE-LE-CH +10 | XX BR-LE-BL +0 | XX BR-LE-BL +0 |
| XX BR-LE-BL +0 | XX LE-LE-CH +10 | XX LE-LE-CH +10 | XX LE-LE-CH +10 | XX LE-LE-CH +10 |
| XX BR-LE-BL +0 | XX BR-LE-BL +0 | XX BR-LE-BL +0 | XX BR-LE-BL +0 | XX BR-LE-BL +0 |
| XX BR-LE-BL +0 | XX LE-LE-CH +10 | XX BR-LE-BL +0 | XX BR-LE-BL +0 | 50 BR-LE-BL +0 |

FIG. 13C

SECURITY METHODS AND APPARATUS FOR A TANGIBLE MEDIUM CONTAINING WAGERING GAME OUTCOMES

This application claims the benefit of U.S. Provisional Application Ser. No. 60/663,545, filed Mar. 18, 2005 and entitled SECURE METHODS, SYSTEMS AND APPARATUS FOR PROVIDING GAMBLING RESULTS THAT MAY BE VIEWED REMOTELY; and claims the benefit of U.S. Provisional Application Ser. No. 60/685,604, filed May 27, 2005 and entitled METHODS, SYSTEMS AND APPARATUS FOR PROVIDING GAMBLING RESULTS THAT MAY BE VIEWED REMOTELY, and claims the benefit of U.S. Provisional Application Ser. No. 60/666,393, filed Mar. 29, 2005 and entitled METHODS, SYSTEMS AND APPARATUS FOR PROVIDING GAMBLING RESULTS THAT MAY BE VIEWED REMOTELY.

The entirety of each of the above-identified applications is incorporated by reference herein for all purposes.

BRIEF DESCRIPTION OF THE FIGURES

Various embodiments of the present invention are described herein with reference to the accompanying drawings. In the drawings, like reference numerals indicate identical or functionally similar elements. The leftmost digit(s) of a reference numeral typically identifies the figure in which the reference numeral first appears. As will be understood by those skilled in the art, the drawings and accompanying descriptions presented herein indicate some exemplary arrangements for stored representations of information. A number of other arrangements may be employed besides the tables shown. Similarly, the illustrated entries represent exemplary information, but those skilled in the art will understand that the number and content of the entries can be different from those illustrated herein. A brief description of the drawings follows.

FIG. 5 is a table illustrating an example available DVDs database in accordance with some embodiments described herein.

FIG. 9C illustrates an example of "marketing material" that may be inserted into the jewel case of FIGS. 9A and 9B.

FIGS. 13A, 13B and 13C illustrate examples of a cashout ticket, a video ticket, and a results ticket, respectively, that may be provided in accordance with some embodiments described herein.

DETAILED DESCRIPTION OF EMBODIMENTS

1. Introduction to Some Embodiments

Figure 1:
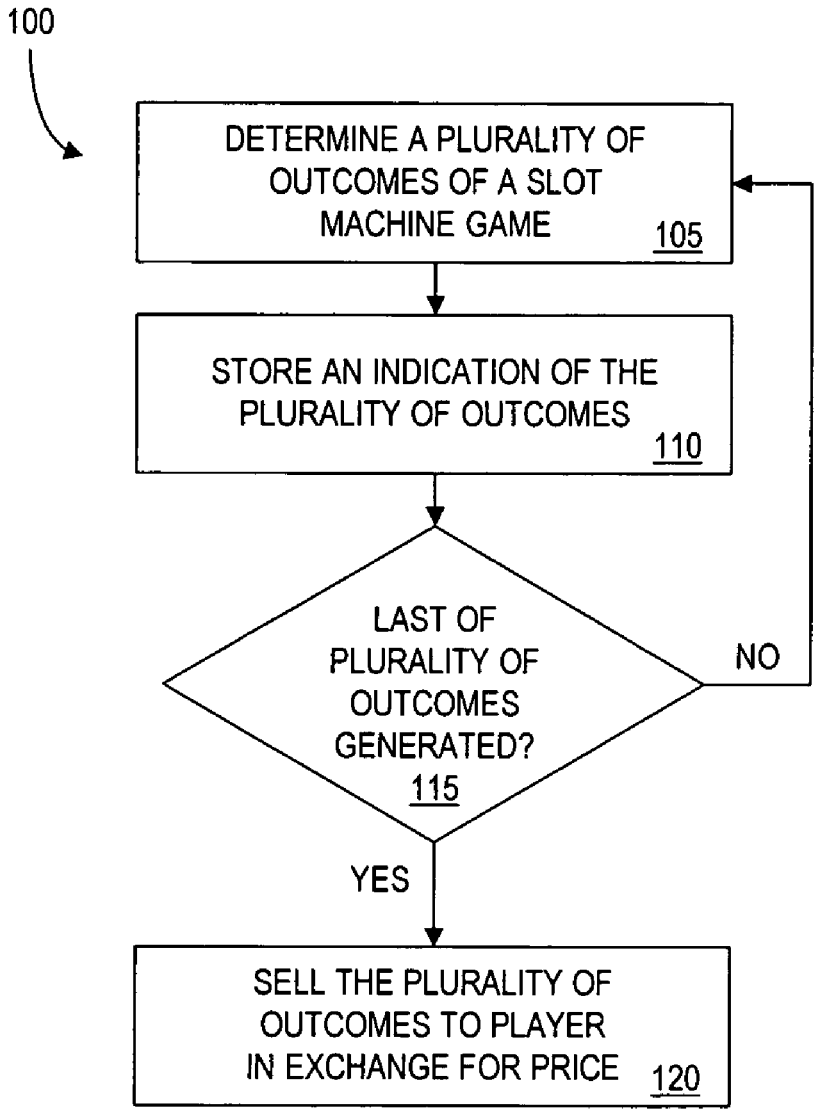
FIG. 1 is a flowchart of an example process according to some embodiments described herein.

In accordance with one or more embodiments, a method provides for determining a plurality of outcomes of a wagering game and storing an indication of the plurality of outcomes. The method further provides for selling, after the last of the plurality of outcomes has been generated, the plurality of outcomes to the player in exchange for a price or other value. The plurality of outcomes may be provided to the player, for example, by being recorded on a tangible medium (e.g., a DVD), wherein the tangible medium has associated therewith at least one tamper evident item. The tangible medium is activated upon receipt of the purchase price and if the tamper evident item passes inspection, as will be described in detail below.

An outcome, as the term is used herein unless indicated otherwise, refers to a result of a game play, which may be indicated by a payout (i.e., a prize or benefit to be provided as a result of the game play) and/or one or more indicia representative of the result. For example, an outcome may comprise the set of indicia (or payout corresponding thereto) that may be displayed along a payline of a reeled slot machine. In another example, an outcome may comprise a roulette number that is a result of a roulette spin. In some embodiments, more than one set of indicia may represent the same result or outcome.

In one embodiment, an outcome may be represented via indicia of a media file. A media file may comprise graphical and/or audio data. The graphical data may comprise a still or animated image of one or more indicia. In some embodiments, more than one media file may correspond to a particular outcome or result. For example, more than one media file may correspond to an outcome that results in zero credits being added to a credit meter balance.

A game, as the term is used herein unless indicated otherwise, comprises a wagering activity conducted in accordance with a particular set of rules via which a prize or benefit may be won in exchange for consideration.

A game play, as the term is used herein unless indicated otherwise, refers to a single instance or round of a game. A game play may result in a single outcome (e.g., set of indicia and corresponding payout, if any).

A type of game, as the term is used herein unless indicated otherwise, refers to a category of games that share one or more characteristics.

In accordance with one or more embodiments, a method provides for causing a plurality of actual outcomes to be generated on a gaming device operable to facilitate a wagering game and determining data indicative of the plurality of actual outcomes. The method further provides for determining, based on the data, a plurality of representations (e.g., images and/or other video and/or audio), each representation representing an outcome to be stored on a tangible medium, each representation thereby comprising a representative outcome. The method further provides for causing the plurality of representative outcomes be stored on a tangible medium and making the tangible medium available for sale.

An actual outcome, as the term is used herein unless indicated otherwise, is an outcome directly determined by a Gaming Device (GD) For example, an actual outcome may comprise the random number determined by the random number generator of a GD, the particular set of indicia that corresponds to the random number based on the probability table used by the GD and/or the payout that corresponds to the random number.

A representative outcome, as the term is used herein unless indicated otherwise, is an indication of an actual outcome, the representation being determined based on the actual outcome and, in some embodiments, by a device other than a GD. For example, an Assembly System (AS) may determine, based on a random number determined by a GD, a media file to represent the actual outcome determined by the GD. The media file may comprise a graphical representation of a set of indicia and this set of indicia may be a representative outcome corresponding to the actual outcome determined by the GD.

It should be understood that, for a particular set of outcomes, the set of actual outcomes may correspond to the same sum of payouts as does the corresponding set of representative outcomes.

In some embodiments, the outcome in a set of actual outcomes that corresponds to a set of representative outcomes may (i) differ in number; (ii) differ in order (i.e., the actual outcomes may have been generated in a first order while the representative outcomes may be presented in a second order); and/or (iii) differ in indicia or form of indicia.

A session, as the term is used herein unless indicated otherwise, is a plurality of game plays conducted for the purpose of determining a plurality of outcomes to be sold to a player. For example, a session may refer to a plurality of game plays executed by a GD, based on which plurality of game plays (e.g., representative outcomes and/or actual outcomes) a video representation of outcomes is created and recorded onto a DVD or other tangible medium, or based on which plurality of game plays the video presentation is otherwise made available to a player. A session may be completed over a plurality of distinct time periods (e.g., some of the outcomes comprising the session may be generated at a first date and/or time while more of the outcomes comprising the session may be generated at a second date and/or time). Further, a session may be executed on a plurality of GDs (e.g., simultaneously or in parallel fashion and/or at various times). A session may be deemed to be completed once an end event defining the end of the session has occurred (e.g., a predefined number of outcomes has been generated, outcomes have been generated for a predefined period of time, a credit meter balance as reached a predefined value, etc.). In some embodiments, a session may be deemed to be completed once one of a plurality of possible end events occurs, whichever end event occurs first.

It should be noted that although the term DVD is used herein to refer to a tangible medium on which an indication of a plurality of outcomes may be recorded and which tangible medium may be sold to a player, this term is used for purposes of brevity only and should not be taken in a limiting fashion. All references to DVD likewise include any other form of tangible medium that may be appropriate and practicable for recording an indication of outcomes (e.g., a video presentation) for subsequent remote viewing by a player. For example, paper (e.g., a flip-through book), a CD-ROM, a VHS tape, flash memory, a memory stick, a digital video tape, an MP3 file, or any other tangible medium for recording information may be used. Further, practicable variations of such media are contemplated (e.g., DVD-R, CD-R, CD-RW, etc.). It should be understood that the use of the term DVD is a reference to any and all such tangible mediums.

In accordance with one or more embodiments, a method provides for receiving, from a player, a request for a payout corresponding to a plurality of outcomes previously sold to the player, wherein the payout is a function of a sum of payouts of the plurality of outcomes, and wherein the plurality of outcomes had been sold to the player as a package without providing to the player an indication of the payout. A payout corresponding to a DVD that is a function of a sum of payouts of the plurality of outcomes or an aggregate of the payouts may be, in some embodiments, the "redemption value" of the DVD or other tangible medium via which session information is remotely viewable. The method further provides for verifying a legitimate purchase of the plurality of outcomes by the player, verifying the payout and providing the payout to the player. In some embodiments, the method may further provide for storing an indication of the payout having been provided to the player and/or verifying that the payout has not previously been provided to the player.

The term "redemption value" is used herein to refer to a monetary amount or prize that a player may redeem a purchased DVD for. This term refers, unless indicated otherwise, to a value that is a function of a sum of payouts (which may be a single payout in some instances), the payouts being the payouts corresponding to the outcomes represented on the DVD. The value may be, for example, a function of (i) the starting credit meter balance at the beginning of the session executed to determine the outcomes represented on the DVD, (ii) a sum of wagers posted for the game plays comprising the session; (iii) the payouts won as a result of game plays comprising the session; and (iv) the payout or payouts won as a result of game plays at a particular point or points within the session. For example, assuming a session is executed with a starting balance of $5.00, twenty game plays are executed during the session at a wager of $0.25 per game play, and three of these game plays result in a payout greater than zero (the first payout being $4.00, the second payout being $12.00 and the third payout being $3.00), the ending credit meter balance at the end of the session is $19.00. Thus, in some embodiments the redemption value of the DVD may be the ending credit meter balance, which is $19.00 in the above example. In other words, a player who purchases this DVD for $20.00 may redeem the DVD for $19.00.

In accordance with one or more embodiments, a method provides for selling a plurality of outcomes as a package, wherein the plurality of outcomes is based on at least one random number result generated by a gaming device operable to facilitate a wagering game, and wherein the selling occurs after the at least one result has been generated and prior to a payout for any outcome of the plurality of outcomes having been provided to a player.

In accordance with some embodiments, provided are apparatus, systems and methods for enabling casino patrons to view gambling results remotely. In one or more embodiments, a player may purchase a session of game plays from a casino. Using a gaming device located within the casino, the session may then be executed on the player's behalf according to parameters of the session (e.g., number of game plays, wager per game play, payout combinations active, game, gaming device or type of gaming device, etc.). For example, a slot machine may be configured to rapidly generate a plurality of outcomes on the player's behalf. In some embodiments, files representing the generated outcomes may then be stored on media (e.g., a CD-ROM or DVD). The player may then remotely view the previously generated outcomes at a later time (e.g., using one or more devices such as home computers, televisions, DVD players, PDAs, cellular phones, and so on), so as to experience wins and losses associated with the session.

Referring now to FIG. 1, illustrated therein is a flowchart of an example process 100 that may be performed in accordance with one or more embodiments. It should be noted that, as is true for all processes described herein, process 100 may, in some embodiments, be performed by a variety of devices and/or persons. For example, one or more of the steps described may be performed by a GD, one or more of the steps may be performed by a Casino Server (CS), one or more of the steps may be performed by a AS, one or more steps may be performed by another device (e.g., CPD, POS, or another device) and/or one or more of the steps may be performed by a person (e.g., a casino attendant or player). Further, the steps may be performed in an order different from that described. Further still, additional or different steps may be included and some steps may be omitted or modified, as appropriate and/or practicable.

In step 105, a plurality of outcomes of a slot machine game is determined. Determining the plurality of outcomes may comprise, for example, determining a plurality of actual outcomes. For example, if step 105 is being performed by a GD, determining a plurality of outcomes may comprise generating a plurality of random numbers, each random number comprising an outcome. If step 105 is being performed by another device (e.g., CS 305 or AS 310, both described below with respect to FIG. 3), step 105 may comprise determining an indication of a plurality of actual outcomes generated by a GD. For example, such an indication may be received via an electronic transmission from a device (e.g., a GD may transmit such an indication to a CS and/or AS via a network connection). In another example, such an indication may be received via a printed document (e.g., a session results ticket or wagering game receipt, described below) may include a bar code or other encoded information readable by a CS and/or AS, for determining the indication.

An indication of the plurality of outcome may comprise, for example, one or more of the following information:

(i) a sum of payouts won as a result of the plurality of outcomes;

(ii) an ending credit meter balance at the end of a session comprising the plurality of outcomes;

(iii) a set of indicia representative of one of the plurality of outcomes (e.g., a result of a roulette spin, a plurality of symbols representing a hand of video poker, a plurality of symbols that may be displayed along a payline of a reeled slot machine, etc.);

(iv) a game for which the plurality of outcomes was determined;

(v) a sum of wagers posted for the plurality of outcomes;

(vi) a price of the session;

(vii) a beginning credit meter balance at the beginning of a session comprising the plurality of outcomes;

(viii) a player associated with the plurality of outcomes (e.g., in embodiments in which a player requests a session prior to it being executed);

(ix) a casino attendant associated with the plurality of outcomes (e.g., the casino attendant who authorized, supervised and/or executed the session comprising the plurality of outcomes);

(x) a unique identifier of a session comprising the plurality of outcomes (e.g., such that information regarding the plurality of outcomes may be determined by accessing an appropriate database based on the unique identifier);

(xi) a unique identifier corresponding to an outcome of the plurality of outcomes;

(xii) an identifier of a media file corresponding to an outcome of the plurality of outcomes;

(xiii) a time and/or date at which an outcome of the plurality of outcomes was generated;

(xiv) a gaming device on which the plurality of outcomes was generated;

(xv) a type of gaming device on which the plurality of outcomes was generated;

(xvi) an activation ID used to determine sale of a session; and (xvii) a redemption ID used to determine redemption of a session.

In some embodiments, determining a plurality of outcomes may comprise determining a plurality of representative outcomes. For example, if step 105 is being performed by an AS, determining a plurality of outcomes may comprise determining an indication of a plurality of outcomes (e.g., the payouts corresponding to each outcome of the plurality of outcomes, a sum of payouts corresponding to the plurality of outcomes, or any other of the information listed above) and selecting representative outcomes to represent a plurality of actual outcomes generated by a GD.

It should be understood that in some embodiments a plurality of outcomes are generated (e.g., a session of game plays is executed to determine a plurality of outcomes to be recorded on a DVD) prior to any player expressing any interest in purchasing the plurality of outcomes. For example, an entity (e.g., casino, GD manufacturer and/or other entity) may create (or cause to be created) DVDs, each DVD having recorded therein a video representation of a plurality of outcomes, and place the created DVDs on a casino floor for purchase by players.

In some embodiments, a player may purchase, request or otherwise agree to a session (e.g., the player may request or order a DVD of outcomes to be created on behalf of the player). In such embodiments, methods for providing gaming contracts and/or flat rate gaming sessions may be applied to embodiments described herein. Many such methods are described in commonly-owned, co-pending U.S. Provisional Application No. 60/627,670, filed Nov. 12, 2004, entitled "GAMING DEVICE OFFERING A FLAT RATE PLAY SESSION AND METHODS THEREOF"; U.S. Provisional Application No. 60/600,211, filed Aug. 10, 2004, entitled "SYSTEMS, METHODS AND APPARATUS FOR ADMINISTERING GAMING CONTRACTS"; U.S. application Ser. No. 10/636,520, filed Aug. 7, 2003, entitled "SYSTEM AND METHOD FOR COMMUNICATING GAME SESSION INFORMATION"; U.S. application Ser. No. 10/635,986, filed Aug. 7, 2003, entitled "SYSTEM AND METHOD FOR REMOTE AUTOMATED PLAY OF GAMING DEVICES"; U.S. patent application Ser. No. 10/001,089, filed Nov. 2, 2001, entitled "GAME MACHINE FOR A FLAT RATE PLAY SESSION AND METHOD OF OPERATING SAME"; and U.S. Pat. No. 6,077,163, filed Jun. 23, 1997, entitled "GAMING DEVICE FOR A FLAT RATE PLAY SESSION AND METHOD OF OPERATING SAME"; the entirety of each are incorporated herein by reference for all purposes.

For example, a player may request a session by (i) actuating an input device of a gaming device, kiosk or other device described herein (e.g., the player actuates an icon of a touch-sensitive display screen advertising "Purchase a DVD" or other similar text), (ii) indicating such a desire verbally to a casino representative (e.g., in person or over the phone), (iii) filling out and submitting forms or other paperwork, and so on.

It should be noted that, in some embodiments, when requesting that a session be executed, a player may provide various contact information (e.g., postal address, phone number, e-mail address, and so on), such that players may be provided with the results of the session via the contact information (e.g., a code my be e-mailed to the e-mail address, the code for accessing the results online or a DVD may be mailed to the postal address, etc.).

In embodiments in which a session is executed prior to any player expressing an interest in the session (e.g., embodiments in which DVDs of sessions are massively produced and made available for purchase), an entity such as a casino, GD manufacturer and/or other entity may define the parameters and values thereof defining a session. For example, such an entity may program a GD to execute 1000 sessions being defined by a set of particular parameters (and values thereof).

In some embodiments, step 105 (or another or additional step) may comprise storing an indication of parameters defining a session in association with the session (e.g., in association with a unique session identifier in a record of an appropriate database). In one or more embodiments, a unique session identifier (e.g., numeric or alphanumeric identification code) may be associated with each session that is executed or that is scheduled for execution. In some embodiments, such information may be stored electronically. For example, various parameters and values thereof may be stored in a record of a database, each record defining a session executed, available for execution and/or scheduled to be executed. It should be noted that such a database may be stored in a variety of locations, including but not limited to within a GD and/or CS. Alternately or additionally, a physical, non-electronic record of such session parameters may be kept. For example, if a player has filled out a paper form indicating various session parameters, the form may be filed away or saved such that it may later be used when executing the session. In another example, both a physical and an electronic record may be kept (e.g., a casino attendant may enter desired session parameters and values thereof using a computing device such that they are recorded in a database, then use a software application of the computing device to print a physical piece of paper indicating the desired parameters and values thereof).

In summary, irrespective of whether a session is prompted by a request from a player or is part of a mass production process, step 105 comprises determining a plurality of outcomes comprising the session. The step may comprise one or more subroutines, such as a subroutine for (i) determining one or more parameters (and values thereof) defining a session comprising the plurality of outcomes; (ii) generating the plurality of outcomes; (iii) determining an indication of the plurality of outcomes (which may comprise determining an indication of a plurality of actual outcomes and/or determining an indication of a plurality of representative outcomes); (iv) decoding or interpreting the indication to determine a plurality of representative outcomes; and/or (v) selecting a plurality of media files, each media file corresponding to an outcome of the plurality of outcomes.

It should be noted that when reference is made to an "outcome" herein, such reference may refer to an actual outcome and/or a representative outcome. In step 110, an indication of the plurality of outcomes is stored. Storing an indication of the outcomes may comprise, for example, one or more of (i) storing an indication of the outcomes in a memory (e.g., a mass storage device) of a device such as a GD, CS or AS; (ii) recording (or causing to be recorded) an indication of the plurality of outcomes on a DVD; and (iii) printing (or causing to be printed) an indication of the plurality of outcomes on a document (e.g., a session results ticket). It should be understood that an indication of a plurality of outcomes may comprise any and all of the information described with respect to step 105.

For example, storing an indication of outcomes may comprise a GD transmitting an indication of the plurality of outcomes to a CS and the CS in turn transmitting the indication (or another indication based on the indication received from the GD) to an AS. Step 110 may further comprise the AS creating a video representation of the plurality of outcomes (e.g., by selecting a plurality of media files, each media file corresponding to one of the plurality of outcomes) and recording the media files onto a DVD.

In one embodiment, storing an indication of the plurality of outcomes may comprise storing a representative outcome for each of the plurality of outcomes. In one embodiment, storing an indication of the plurality of outcomes may comprise recording a plurality of media files onto a DVD, each media file corresponding to one outcome of the plurality of outcomes or, alternatively, combining the plurality of media files into a single media file and storing that to the DVD. In one embodiment, storing an indication of the plurality of outcomes may comprise storing an indication of each outcome of the plurality of outcomes.

In one embodiment, storing an indication of the plurality of outcomes may comprise populating a record of an appropriate database (e.g., with an indication of each outcome of the plurality of outcomes) for subsequent creation of a video presentation of the plurality of outcomes. For example, a first program of a device may receive an indication of the plurality of outcomes and determine particular representative outcomes (e.g., particular payouts and the order thereof, particular media files and the order thereof, and/or particular sets of indicia, each set corresponding to an outcome of the plurality of outcomes). This first program may cause the determined information to be stored in a database. A second program may then create a video representation of the outcomes. A third program may then cause the video presentation to be recorded onto a DVD. Of course, a single program may be used or the first, second and third program may be combined in any manner practicable and desirable. Further, the first, second and third program may each be performed by different devices or the same device, and the devices may or may not be geographically proximate to each other, depending on what is practicable and desirable.

In one or more embodiments, step 110 may comprise storing a result of a session (e.g., an indication of outcomes determined for the session) in an electronic manner. For example, as described, data associated with a session may be stored electronically in a session database. In some embodiments, session data may be stored on a smart card (e.g., a smart card inserted into a reader device in communication with a GD) or another portable storage medium.

Storage and/or transmission of an indication of the plurality of outcomes may occur at any time. For example, some indication of the plurality of outcomes may be stored and/or transmitted prior to the execution of a session corresponding to the plurality of outcomes (e.g., an indication of the session identifier and/or parameters of the session may be stored in a record of a database upon the session being scheduled and/or ordered). In another example, some indication of the plurality of outcomes may be stored and/or transmitted during or after the execution of a session (e.g., game play results are individually stored as they are generated; game play results are stored in RAM while they are being generated, then written to ROM and erased from RAM; and so on). Thus, step 110 may comprise transmitting and/or storing an indication of a plurality of outcomes electronically to a memory.

It should be appreciated that such data may be stored electronically in a variety of formats. For example, various data may be stored as records of a database entry associated with a session identifier. For example, in one embodiment, a database may store text indicating any or all of a wager amount, outcome, outcome identifier and payout amount associated with a particular game play number (e.g., the first game play of a session is game play "1"). In some embodiments, an indication of a plurality of outcomes or other data associated with a session may be stored electronically in an encoded fashion. For example, a bit function representing an outcome may be stored in a database (e.g., "BAR-LEMON-CHERRY" is stored as 0129-2938-3847, each four-digit sequence representing a particular symbol).

In some embodiments, storing an indication of the plurality of outcomes may comprise accessing a media file database to determine a media file (e.g., a media file associated with a result of a game play), and then storing an indication of a game play number along with an associated media file.

Alternately or additionally, storing an indication of the plurality of outcomes may comprise outputting the indication in some physical, non-electronic fashion. For example, in some embodiments, a GD may actuate a printer device to print a bar code encoding the indication of the plurality of outcomes (e.g., an indication of a session result). For example, a GD may print upon a conventionally sized TITO ticket a high-density barcode encoding an indication of the plurality of outcomes associated with an executed session. For example, text, numerals or other symbols stored within a session database (e.g., a series of outcome identifiers) may be encoded such that they are represented graphically by a barcode such as a high-density barcode. Various methods of encoding such text and/or numerals graphically using a high-density barcode are contemplated. In further embodiments, encoding an indication of the plurality of outcomes as a printed barcode may comprise accessing a media file database to determine a media file associated with an outcome, and then encoding a game play number along with an associated media file or indication of an associated media filed (e.g., an identifier that uniquely identifies a media file).

Accordingly, in various embodiments, storing an indication of the plurality of outcomes may comprise outputting and/or storing the indication in an electronic and/or physical fashion. As described, in some embodiments, a session may have been executed without interaction from a user (e.g., agent), as an electronic signal instructing a GD to execute a session defined by certain parameters and values thereof may be sent by a separate device. Accordingly, in some embodiments, a person (e.g., a casino attendant or player) may approach a GD and access or attain an indication of the plurality of outcomes corresponding to the session. For example, a casino attendant may be dispatched to collect a cashout ticket, video ticket and/or session results ticket from a GD. In another embodiment, a casino attendant may be dispatched with a smart card or other portable memory device (e.g., a CPD). The casino attendant may insert the smart card into a reader device of a GD, and the indication of the plurality of outcomes may be transferred or copied from a memory of the GD to a memory of the smart card or other portable memory device. For example, in one embodiment, an indication of the plurality of outcomes may be stored temporarily in GD memory until it is retrieved by a casino attendant or player (and, e.g., transferred to a smart card) and/or transmitted to another device.

In step 115, it is determined whether the last of the plurality of outcomes have been generated. In some embodiments, a session is not considered to be completed (and thus the results of the session not ready for sale or other provision to a player) until the last of the outcomes comprising the session have been generated. Accordingly, it may be determined whether the last of the outcomes have been generated. For example, a parameter of a session defining the duration of the session may be determined (e.g., a number of outcomes) and compared to the data comprising the indication of the plurality of outcomes. If the data indicates that the number of outcomes defined by the parameter is the same as the number of outcomes indicated by the indication, it may be determined that the last of the plurality of outcomes has been generated. In another example (e.g., one in which step 115 is being performed by a GD), determining whether the last of the plurality of outcomes have been generated may comprise determining whether the session has been completed by determining whether the end event defined by a parameter of the session has occurred (e.g., determining an elapsed time since a beginning of the session).

In some embodiments an indication of a plurality of outcomes may not be received by a particular device performing step 115 unless and until the last of a plurality of outcomes has been generated. In such embodiments, step 115 may be superfluous. Alternatively, an affirmative determination to step 115 may be determined if it is determined that the indication of the outcomes has been received.

In one embodiment, step 115 may further comprise determining whether the last of representative outcomes corresponding to actual outcomes of a session have been determined. For example, if step 115 is being performed by a device creating a video representation of the outcomes or selecting media files for the plurality of outcomes, each media file comprising a representative outcome, step 115 may comprise determining whether the last of the representative outcomes has been determined (e.g., whether a representative outcome for each of a plurality of actual outcomes comprising a session has been determined).

If it is determined that the last of the plurality of outcomes has not been generated (e.g., the session comprising the plurality of outcomes is not yet complete), the process returns to step 105, in which the remainder of the plurality of outcomes (or more of the plurality of outcomes) are determined. Otherwise, the process 100 continues to step 120.

In step 120, the plurality of outcomes is sold to a player in exchange for a price. Of course, it should be understood that in some embodiments the plurality of outcomes may be provided to a player without receiving a price therefore. For example, the plurality of outcomes may be provided as a reward (e.g., for loyalty to a casino or certain desirable play behavior), gift or incentive. Further, it should be understood that the price received in exchange for the plurality of outcomes may be a monetary amount (e.g., U.S. dollars) or may be in another form of consideration. For example, a player may agree to perform an activity or engage in a behavior in exchange for the plurality of outcomes. For example, a player may answer survey or marketing questions and/or commit to returning to a casino within a predetermined time frame.

Selling the plurality of outcomes to a player in exchange for a price may comprise, for example, selling a DVD to the player, the DVD having recorded thereon a video representation of the plurality of outcomes. Additional detail on such an embodiment is provided below.

In some embodiments, selling the plurality of outcomes to a player may comprise providing an indication of the plurality of outcomes to a player who has previously ordered or requested that the plurality of outcomes be generated, and may have already paid for the outcomes. In such embodiments, selling the plurality of outcomes to the player may comprise communicating (e.g., transmitting) an indication of the outcomes (or an indication of an availability of the outcomes) to the player. For example, a DVD may be mailed to the player or a code or other information (e.g., an executable file that displays representative outcomes when opened or run) may be e-mailed to the player.

In one embodiment, selling the plurality of outcomes to a player may occur at a POS of a casino. For example, a player may request to purchase a DVD of outcomes at the POS. The sale of the DVD may involve various procedures for ensuring the security and legitimate sale of the DVD, and such procedures are described in detail herein.

As described, in one embodiment selling a plurality of outcomes to a player may comprise providing the player access to a video presentation representing the outcomes, such that the player may view game results from a location that is remote from a casino (though the results themselves may have been generated within a casino). In some embodiments, player contact information received when a player purchases a session or video presentation based on the session (e.g., address, phone number, e-mail address) may be used in providing the player access to the video presentation.

In some embodiments, a video presentation of a plurality of outcomes comprising a session may be output via tangible media such as a DVD or CD-ROM. Accordingly, in some embodiments, such tangible media may be provided, shipped or mailed to a purchaser of a session. For example, the tangible media may be handed to the player upon the player purchasing the session, may be mailed to a mailing address indicated by a player, may be stored in a centrally-accessible database or in written form, etc.

Figure 2:
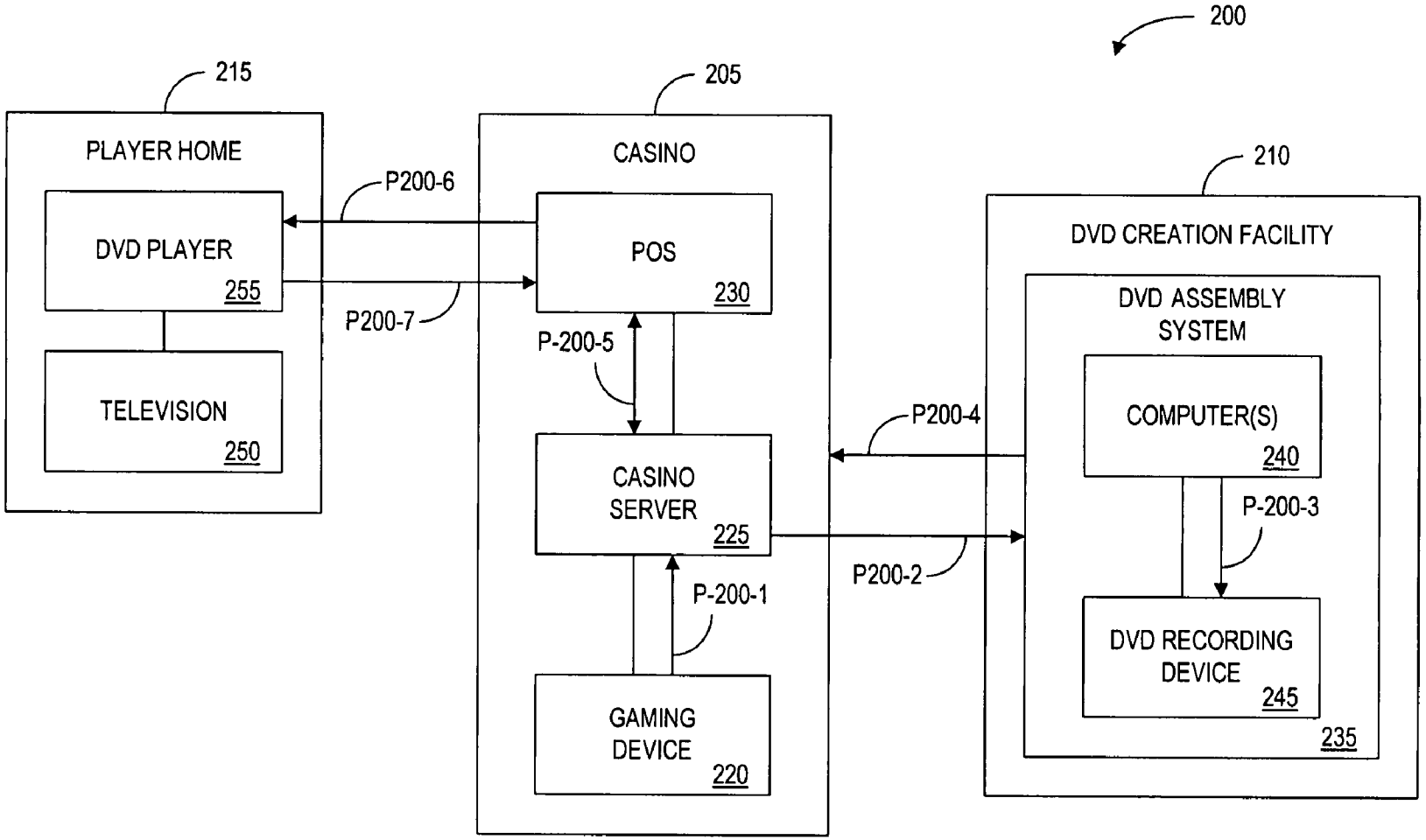
FIG. 2 is a block diagram of an example "life cycle" of a DVD according to some embodiments described herein.

It should be understood that the various steps of process 100 may occur at different locations. For example, a plurality of outcomes may be generated at a casino and transmitted to a DVD assembly facility that is remote from the casino. The DVD assembly facility may then create a DVD having recorded therein a video representation of the plurality of outcomes. The DVDs assembled at such a DVD assembly facility may then be transported to another location (e.g., to a casino, to be made available for sale to players or directly to a player's home if the player has previously ordered a DVD). FIG. 2, described below, illustrates the various processes and locations that may be involved in some embodiments of the present invention.

Referring now to FIG. 2, illustrated therein is a block diagram of an example "life cycle" of a DVD according to some embodiments described herein. The block diagram illustrates the various entities and processes that may be involved in at least one embodiment described herein. It should be noted that each of the processes described briefly with respect to FIG. 2 is described in detail herein. FIG. 2 is provided herein to illustrate one possible implementation of some embodiments.

As illustrated in FIG. 2, in accordance with some embodiments three distinct locations may be involved in providing a DVD of outcomes to a player. The first location is a casino 205, at which a player may purchase and redeem a DVD. The second location is a DVD creation facility 210, at which a DVD of outcomes may be created based on outcomes determined by a GD. The third location is a player's home 215 or other location remote from a casino, at which location a player may view a DVD of outcomes.

The casino 205 may include a CS 225 that facilitates the sale and redemption of DVDs of outcomes. The CS 225 is in communication with a GD 220 at which outcomes are created, based on which outcomes a video presentation of outcomes for the DVD will be created. The CS 225 is also in communication with a POS 230, at which a player may purchase a DVD of outcomes.

The DVD creation facility includes a DVD assembly system 235 (DVD AS 235). The DVD AS 235 is comprised of a computer 240 and a DVD recording device 245.

The player home 215 may include a TV 250 in communication with a DVD player 255. It should be understood, of course, that if a tangible medium other than a DVD is used to provide a video presentation of outcomes to a player, the player home 215 may include devices appropriate for reading and outputting the video presentation to a player (e.g., if the outcomes are stored on a CD-ROM, the player home may include a personal computer (PC) operable to read and output the information recorded on the CD-ROM).

A player's obtainment of a DVD of outcomes may begin with a process P-200-1, in which process GD 220 generates a plurality of outcomes for a session and communicates (e.g., transmits) an indication of the plurality of outcomes to CS 225. In an alternate embodiment, GD 220 may communicate an indication of the plurality of outcomes directly to AS 235 (e.g., in lieu of or in addition to communicating the indication to CS 225). It should be noted that, as described, a player may have requested the plurality of outcomes or session prior to the outcomes being generated. In such embodiments, a player's obtainment of a DVD of outcomes may instead begin with a process in which a player approaches a POS 230 to request the plurality of outcomes (and, e.g., provides the desired parameters and values thereof for the session comprising the plurality of outcomes). However, for purposes of simplicity, FIG. 2 illustrates an embodiment in which DVDs are mass produced, without the creation of a DVD being dependent on a player requesting a purchase of a particular session.

Once the GD 220 (or another device since, as described herein, any reference to a particular device performing a particular function is not meant to be limiting since the function may be performed by another device, as desired and practicable) transmits an indication of the plurality of outcomes, which will be referred to as session result data at least for purposes of FIG. 2, the CS 225 communicates the session result data to DVD AS 235. For example, the CS 225 may electronically communicate the session result data in an encrypted fashion to CS 225. The session result data may include, for example, an indication of one or more of (i) a game for which the plurality of outcomes were generated; (ii) a price of the session; (iii) a beginning credit meter balance for the session; (iv) an ending credit meter balance for the session; (iv) a number of game plays included in the session; (v) a wager per game play; (vi) a sum of payouts obtained for the session; (vi) particular outcomes (e.g., sets of indicia and/or payouts) obtained during the session; (vii) a strategy employed during the session (e.g., if any decision-making is required during a game play); and/or (viii) a session identifier.

The computer 240 may then create a video presentation based on the received session result data. For example, the computer 240 may select or create appropriate media files (e.g., video clips, each video clip corresponding to a particular representative outcome to be included in the video presentation) based on the received session result data. The computer 240 may also determine an order in which the media files are to be put together in the video presentation. Such an order may be determined, for example, based on an order in which outcomes were generated by GD 220 (which order may be included in the session result data received). It should be understood that a video presentation created in accordance with some embodiments may include data other than the mere representation of outcomes obtained as a result of a session. For example, inserted pauses to mimic a time at which a player would normally pull a slot machine handle or otherwise initiate the next game play may be interspersed between each video clip representing an outcome, to approximate the experience a player may have while playing a GD on a casino floor. This additional data may be, in some embodiments, additional video data, or in other embodiments, navigation data such as DVD pause commands. In another example, audio and/or video of messages may also be included (e.g., congratulatory messages appear upon an outcome corresponding to a large payout being displayed).

Once the computer 240 creates a video presentation (e.g., selects the media files to be included in the video presentation and the order thereof), the computer 240 may, in process P-200-3, direct the DVD recording device to record the video presentation onto a DVD. The DVD recording device records (e.g., stamps) the video presentation onto a DVD.

Once the DVD is created (which, in some embodiments, may include inserting or packaging the DVD in a jewel case, including marketing materials with the DVD, labeling the DVD with unique identifiers (e.g., in the form of barcodes) as appropriate, and wrapping the DVD in secure packaging), the DVD is transported from the DVD creation facility 210 or Assembly System (AS) to the casino 205 in process P-200-4. For example, a shipment of DVDs created in accordance with the above processes may be shipped to the casino. Additionally, data indicative of the DVDs created and being shipped may be communicated to the casino 205. For example, an indication of a unique DVD identifier that corresponds to a unique session identifier of a session based on which the DVD was created may be communicated. Such information may be communicated electronically and/or via printed form (e.g., as documents included in the shipment).

Once the DVD arrives at the casino 205, it is made available for purchase to players. For example, the DVD may be placed on a display of DVDs on a casino floor (e.g., next to a GD that is operable to facilitate a game based on which the outcomes of the DVD were generated), behind a casino counter, in a casino hotel room, etc. Information regarding the DVD is stored in CS 225. For example, the unique DVD identifier (which may also be included on the DVD and/or DVD packaging) may be stored in an available DVDs database, along with other information associated with the DVD (e.g., a redemption value of the DVD and a status of the DVD (e.g., whether it has yet been sold and/or redeemed)).

A player who desires to purchase the DVD may then request to purchase the DVD at POS 230. For example, a player may select the DVD from a display on a casino floor and bring it to POS 230. In another example, the DVD may be available at a merchant associated with the casino and POS 230 and the player may select the DVD from a shelf of the merchant and present it for purchase at POS 230. In yet another example, the DVD may be located behind an employee counter of a POS 230 and the player may request to purchase the DVD by informing a casino attendant, who selects the DVD from behind the counter for the player. The purchase of the DVD is facilitated in process P-200-5, in which process the POS 230 communicates with CS 225 to verify that the DVD has not previously been purchased and is available for sale. The process P-200-5 may include other steps for ensuring that the DVD is sold in a secure manner, as described in detail herein. For example, an identifier of the player may be received and/or an activation code for the DVD may be received from CS 225. A casino representative may also be required to scan a barcode or other indicia of the DVD in a designated area that includes video surveillance equipment, for example, to ensure that tampering does not occur prior to sale. Once the player provides the appropriate price for the DVD, the player is provided with the receipt and DVD and the purchase is complete.

The player may then take the DVD home in process P-200-6 and view the video presentation of outcomes at his leisure. The player may subsequently return to the casino and request a payment of the redemption value of the DVD, in process P-200-7. For example, the player may visit POS 230 in order to redeem the DVD. For example, if the ending credit meter balance of a session, which the DVD redemption value is a function of, is greater than zero, the player may obtain the redemption value by returning to the casino with the DVD and receipt.

Upon receiving a request to collect a redemption value of a DVD at a POS 230, a process P-200-8 is performed for verifying and authorizing the provision of the redemption value to the player. For example, a legitimate purchase by the player of the DVD may be verified. Additionally, it may be verified that the redemption value has not previously been collected. An example redemption process for redeeming a redemption value of a DVD is described in detail herein.

Of course, it should be understood that a player need not view the video presentation in order to collect the DVD redemption value. As described herein, in some embodiments a player may be allowed to collect the redemption value of a purchased DVD without ever opening the DVD and/or without viewing the video presentation of the DVD. Further, it should be noted that, in some embodiments, a player need not return to the casino in order to collect the DVD redemption value. As is described herein, in some embodiments the DVD redemption value may be provided to the player who purchased the DVD after a predetermined period of time from the purchase of the DVD passes (e.g., one month after the DVD is purchased, a check for the redemption value is mailed to the player if the player has not yet collected the redemption value). In some embodiments, a player may request to collect the redemption value of a DVD without being required to visit the casino (e.g. a player may call or e-mail the casino or send in his DVD and receipt therefore via postal mail in order to collect the redemption value).

In some embodiments, as described herein, a player may be provided with a benefit for returning to a casino after purchasing a DVD even if the DVD redemption value is zero or the credit meter balance associated with the session based on which the DVD was created was zero. For example, a player may be provided with free game plays, comp points, discounts, or other prizes.

2. Systems

Figure 3:
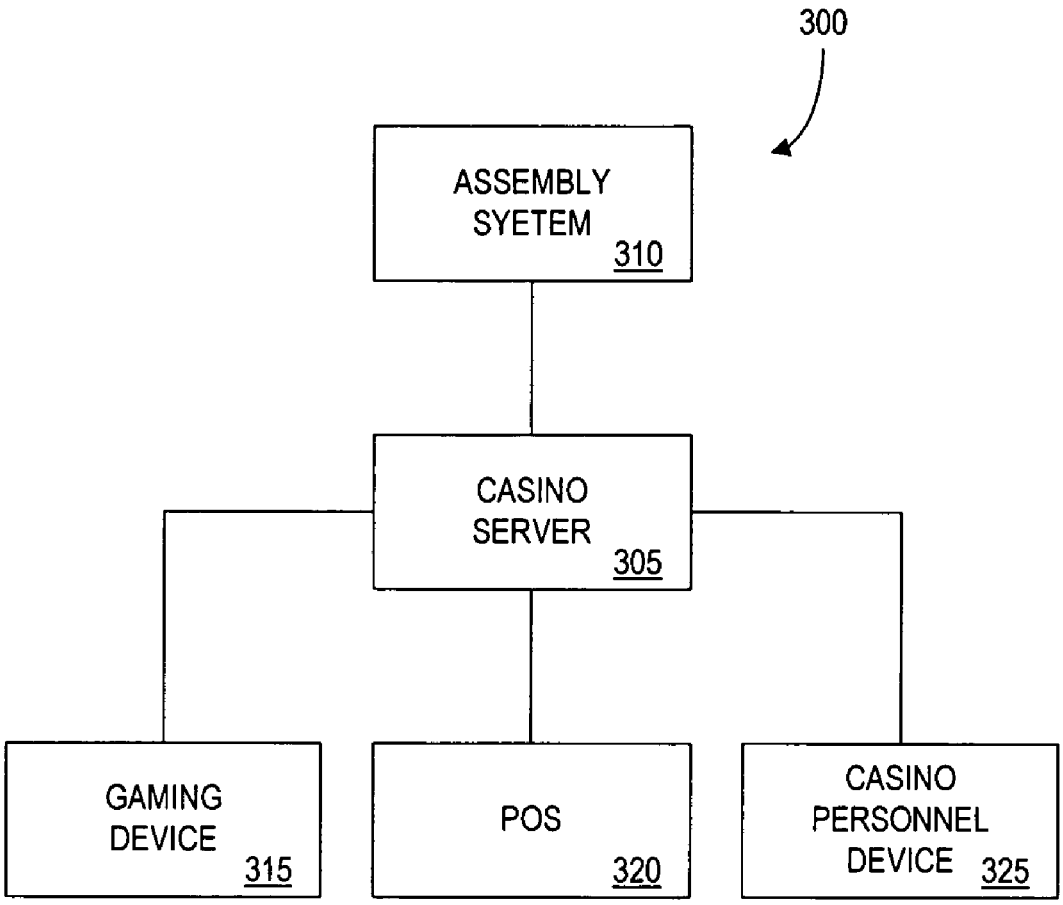
FIG. 3 is a block diagram of an example system in accordance with some embodiments described herein.

Referring now to FIG. 3, illustrated therein is a block diagram of an embodiment 300 of an example system that may be utilized to implement one or more embodiments described herein. Embodiment 300 is referred to as system 300 herein. The system 300 comprises a casino server 305 (CS 305). An example embodiment of CS 305 is described in detail herein with respect to FIG. 4.

The CS 305 is operable to communicate with an assembly system 310 (AS 310). The AS 310 may be operable, for example, to assemble or otherwise create or facilitate DVDs or other tangible media storing outcomes in accordance with embodiments described herein. In one embodiment, AS 310 may be located in a location remote from a casino in which a CS 305 is located. In other embodiments, AS 310 may be located in the same location as CS 305. In one embodiment, some or all of the functions described herein as being performed by AS 310 may instead or in addition be performed by CS 305 and/or another device. In some embodiments CS 305 and AS 310 are operated by the same entity, irrespective of whether they are each located in the same location or remote locations (e.g., a casino may operate both). In other embodiments, CS 305 is operated by a first entity (e.g., a casino) while AS 310 is operated by a second entity (e.g., a manufacturer of gaming devices).

The CS 305 is further operable to communicate with one or more gaming devices 315 (GD 315). A GD 315 may be operable, for example, to generate a plurality of outcomes in accordance with embodiments described herein. A GD 315 may comprise, in one embodiment, a GD on a casino floor that is also operable to be used by a player in a conventional manner. In other embodiments, GD 315 may comprise a modified GD (MGD). Although only a single GD is shown, any number of GDs may be used.

The CS 305 is further operable to communicate with a Point-of-Sale 320 (POS 320). Although only a single POS is shown, any number of POSs may be used. The CS 305 is further operable to communicate with a casino personnel device 325 (CPD 325). A CPD may be used, for example, by an employee of a casino to facilitate one or more embodiments described herein. Although only a single CPD is shown, any number may be used.

In some embodiments, various casino locations (e.g., change booths, customer service counters, kiosks, shops, restaurants, etc.) may utilize POS terminals to facilitate various processes described herein. For example, in some embodiments, a player may purchase a DVD containing a plurality of outcomes previously generated by a GD 315 via a POS 320. In another example, a player may request at a POS 320 that a plurality of outcomes be generated in accordance with one or more parameters specified by the player and stored on a DVD to be provided to the player. Thus, in some embodiments, a POS may be utilized to (i) receive from a player a request to purchase a DVD of outcomes; (ii) verify and/or authorize the sale of the DVD; (iii) accept payment in exchange for the DVD; and/or (iv) provide a payout corresponding to the DVD upon a player's authorized redemption of the DVD by submitting a wagering receipt, for example, which was provided to the player when she purchased the DVD. In some embodiments, a POS 320 may be operable to communicate with CS 305 to authorize the sale and/or redemption of a DVD. In some embodiments, a POS 320 may be configured to read from and/or write to one or more databases of the present invention (e.g., an available DVDs database). In some embodiments, a POS 320 may comprise various hardware and software described herein with respect to other devices (e.g., a keyboard, processor, display, etc.). In some embodiments, a POS 320 may be operable to communicate with a device in addition to CS 305. For example, POS 320 may be operable to communicate with an inventory/reservation system (e.g., a computer terminal at a theatre communicates with an inventory database to determine a number of unsold seats for a certain event). In some embodiments, CS 305 may function as an inventory/reservation system.

In some embodiments, various casino employees may be equipped with or otherwise utilize one or more CPDs. A CPD 325 may comprise, for example, a PDA or other computing device (e.g., a personal computer terminal). A CPD 325 may comprise various input devices (e.g., a keypad, a touch-sensitive display screen, a card reader, an infrared bar code scanner, etc.), various output devices (e.g., an LCD screen), a processor, a memory and/or a communications port, as described herein with respect to other devices. In some embodiments, a CPD 325 may be operable to communicate with a GD 315, CS 305, another server, a kiosk, a peripheral device, AS 310 and/or an inventory/reservation system of a casino-maintained property (e.g., a hotel). Thus, a CPD 325 may be configurable to, among other things, (i) read from and/or write to one or more databases of the present invention, (ii) assist in payments made to players (e.g., a representative "scans" a receipt for a purchased DVD and determines a value associated with the receipt, and if the receipt is valid, provides payment equal to the value), (iii) assist in payment made by players (e.g., a casino representative may receive a payment from a player for purchasing a DVD as described herein and obtain an activation code for the DVD to provide to the player); (iv) cause a GD to generate a plurality of outcomes for storage on a DVD in accordance with embodiments described herein; and/or (v) execute or assist in the execution of various other processes described herein. In one or more embodiments, a CPD may be operable to read data from and/or write data to one or more of the databases described herein. A memory of a CPD may store a program for executing processes described herein, or portions thereof.

The CS 305 may communicate with any and all of AS 310, GD 315, POS 320 and CPD 325 directly or indirectly, via a wired or wireless medium such as the Internet, LAN, WAN or Ethernet, Token Ring, or via any appropriate communications means or combination of communications means. For example, in one embodiment communication among any and all of the devices of system 300 may occur over the Internet through a Web site maintained by computer on a remote server or over an on-line data network including commercial on-line service providers, bulletin board systems and the like. In yet other embodiments, communication among any of the devices of system 300 may occur over RF, cable TV, satellite links and the like.

It should be noted that the lines connecting the various devices of system 300 do not imply that the devices are operable to communicate via a particular network. For example, AS 310 may not be located on a network that CS 305, GD 310, POS 320 and CPD 325 are located on.

Further, any and all of the CS 305, AS 310, GD 315, POS 320 and CPD 325 may comprise a computing device (or one or more computing devices), such as those based on the Intel@ Pentium® processor.

In some embodiments, communication among some or all of the devices 300 may occur over a network. Some, but not all, possible communication networks that may comprise the system 300 include: a LAN, a WAN, the Internet, a telephone line, a cable line, a radio channel, an optical communications line, and a satellite communications link. For example, GD 315 may communicate with CS 305 over a LAN while CS 305 may communicate with AS 310 over a WAN or via a cable line.

Possible communications protocols that may be part of the system 300 include: Ethernet (or IEEE 802.3), SAP, ATP, Bluetooth™, and TCP/IP. Communication may be encrypted to ensure privacy and prevent fraud in any of a variety of ways well known in the art.

A variety of communications protocols may be part of the system 300 or another system operable to facilitate the embodiments described herein, including but not limited to: Ethernet (or IEEE 802.3), SAP, SAS™, SuperSAS™, ATP, Bluetooth™, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device and various component devices and/or peripheral devices (e.g., printers, bill acceptors, etc.), (ii) the Best of Breed (BOB) standard, which may facilitate communication between a gaming device and various servers related to play of one or more gaming devices (e.g., servers that assist in providing accounting, player tracking, content management, ticket-in/ticket-out and progressive jackpot functionality), and/or (iii) the System-to-System (S2S) standard, which may facilitate communication between game-related servers and/or casino property management servers (e.g., a hotel server comprising one or more databases that store information about booking and reservations). Communication may be encrypted to ensure privacy and prevent fraud in any of a variety of ways well known in the art.

In some embodiments, a CS 305 may not be necessary and/or preferred. For example, one or more embodiments may be practiced on a stand-alone GD 315 (e.g., one operable to output a DVD of outcomes, and/or one associated with a device operable to output a DVD of outcomes) and/or a GD 315 operable to communicate with AS 310 directly. In such embodiments, any functions described as performed by the CS 305 or data described as stored on the CS 305 may instead be performed by or stored on one or more GD 315 and/or AS 310.

It should be understood that referring to CS 305 as a "casino" server is not meant to imply that a casino controls, or exclusively controls, this device or all functions thereof. For example, in one embodiment CS 305 is a device operated by an entity other than a casino (e.g., an entity that also operates AS 310 or controls some functions of AS 310). CS 305 may be any device operable to facilitate the creation of a DVD that stores a plurality of outcomes in accordance with embodiments described herein.

In one embodiment, CS 305 may in turn be in communication with another electronic device that is distinct from a GD 315 and/or AS 310, which electronic device may be operable to (i) direct the CS 305 to perform certain functions and/or (ii) read data from and/or write data to the CS 305. For example, the CS 305 may comprise a slot server or Data Collection Unit (DCU) that controls and/or communicates with a bank of slot machines, which slot server or DCU is in turn in communication with a casino server that is in communication with a plurality of such slot servers or DCUs.

In another embodiment, the CS 305 may be operable to communicate with a GD 315 via another electronic device (e.g., a DCU), such as a server computer operable to communicate with a plurality of slot machines. For example, in one embodiment, the CS 305 may be operable to communicate with a plurality of computing devices, each computing device operable to communicate with a respective plurality of gaming devices.

It should be noted that, in some embodiments, one or more of the devices described with respect to system 300 may be combined (or the functions described with respect to may be combined as being performed by) a single device. For example, CS 305 and AS 310 may comprise the same device or a single device may perform the functions described herein as being performed by the two devices as embodying two distinct devices. In another example, GD 315 may comprise CS 305 and/or AS 310 and may, in some embodiments, perform some or all of the functions described herein as being performed by CS 305 and/or AS 310, and vice versa.

Figure 4:
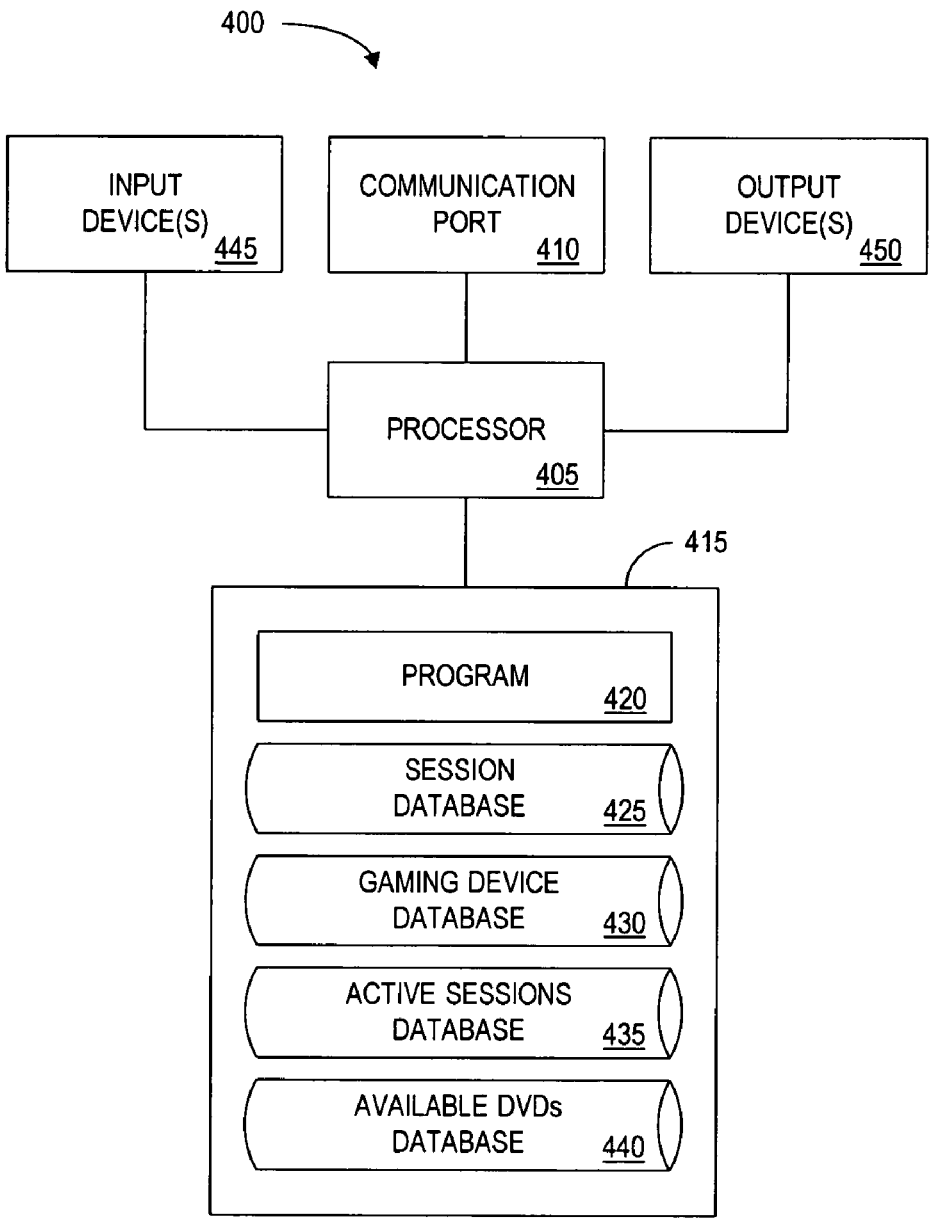
FIG. 4 is a block diagram of an example casino server (CS) in accordance with some embodiments described herein.

Referring now to FIG. 4, illustrated therein is a block diagram of an example embodiment 400 of a CS (e.g., the CS 305 of FIG. 3). The embodiment 400 is referred to herein as CS 400. The CS 400 may be implemented as a system controller, a dedicated hardware circuit, an appropriately programmed general-purpose computer, or any other equivalent electronic, mechanical or electromechanical device. The CS 400 may comprise, for example, one or more server computers operable to communicate with one or more client devices, such as one or more GDs, an AS, one or more kiosks, one or more POSs, one or more peripheral devices, and/or one or more CPDs. The CS 400 may be operative to manage the system 300 or at least to facilitate some functions or procedures described herein.

In operation, the CS 400 may function under the control of a casino, another merchant, an entity that may also control use of the GD 315, and/or a GD manufacturer. For example, the CS 400 may be a slot server in a casino. In some embodiments, the CS 400 and a slot server may be different devices. In some embodiments, the CS 400 may comprise a plurality of computers operating together. In some embodiments, the CS 400 and a GD 315 may be the same device.

The CS 400 comprises a processor 405, such as one or more Intel® Pentium® processors. The processor 405 is in communication with a communication port 410 (e.g., for communicating with one or more other devices, such as one or more GDs 315 and/or AS 310) and a memory 415. The memory 415 may comprise an appropriate combination of magnetic, optical and/or semiconductor memory, and may include, for example, Random Access Memory (RAM), Read-Only Memory (ROM), a compact disc and/or a hard disk. The processor 405 and the memory 415 may each be, for example: (i) located entirely within a single computer or other device; or (ii) connected to each other by a remote communication medium, such as a serial port cable, telephone line or radio frequency transceiver. In one embodiment, the CS 400 may comprise one or more devices that are connected to a remote server computer for maintaining databases.

The memory 415 stores a program 420 for controlling the processor 405. The processor 405 performs instructions of the program 420, and thereby operates in accordance with at least some of the methods described in detail herein. The program 420 may be stored in a compressed, uncompiled and/or encrypted format. The program 420 furthermore includes program elements that may be necessary, such as an operating system, a database management system and "device drivers" for allowing the processor 405 to interface with computer peripheral devices. Appropriate program elements are known to those skilled in the art, and need not be described in detail herein. The program 420 may include computer program code that allows the CS 400 to employ the communication port 410 to communicate with a GD 315 and/or an AS 310 in order to, for example:

1. track gambling or other activity performed at the GD;
2. instruct a GD to generate a plurality of outcomes in accordance with one or more parameters;
3. receive an indication of a plurality of outcomes generated by a GD;
4. transmit an indication of a plurality of outcomes generate by a GD to an AS;
5. receive an indication of a DVD of outcomes that is available for sale;
6. receive a request from a player to create a DVD of outcomes;
7. instruct a gaming device to perform one or more functions (e.g., output a message to a player, interrupt play, etc.);

8. authorize a sale of a DVD to a player;

9. authorize a redemption of a DVD by a player; and/or 10. determine an activity status of a GD.

According to some embodiments, CS 400 may be operable to perform some of the processes (or portions thereof) described herein. For example, CS 400 may be operable to perform at least a portion of the process 100 (described with respect to FIG. 1, above), and/or any other process described herein.

According to an embodiment, the instructions of the program 420 may be read into a main memory from another computer-readable medium, such from a ROM to RAM. Execution of sequences of the instructions in program 420 causes processor 405 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

The memory 415 also stores (i) a session database 425; (ii) a gaming device database 430; (iii) an active sessions database 435; and (iv) an available DVDs database 440.

In some embodiments (e.g., in an embodiment in which CS 400 manages downloadable games playable on one or more GDs), the memory 415 may store additional databases. Examples of such additional databases include, but are not limited to, (i) a game database that stores information regarding one or more games playable on and/or downloadable to one or more GDs, and (ii) a scheduling and/or configuration database useful for determining which games are to be made available on which GDs at what times. In other embodiments, some or all of these functions may be handled by a device distinct from CS 400.

Similarly, in one embodiment CS 400 may be operable to configure a GD (and/or another device, such as a kiosk, POS, CDP, etc.) remotely, update software stored on a GD and/or to download software or software components to a GD. For example, CS 400 may be operable to apply a hot fix to software stored on a GD, modify a payout and/or probability table stored on a GD and/or transmit a new version of software and/or a software component to a GD. The CS 400 may be programmed to perform any or all of the above functions based on, for example, an occurrence of an event (e.g., a scheduled event), receiving an indication from a qualified casino employee and/or other person (e.g., a regulator) and/or receiving a request from a player. In other embodiments, some or all of these functions may be handled by a device distinct from CS 400.

Although the databases 425 through 440 are described as being stored in a memory of CS 400, in other embodiments some or all of these databases may be partially or wholly stored, in lieu of or in addition to being stored in a memory of CS 400, in a memory of one or more other devices. Such one or more other devices may comprise, for example, one or more peripheral devices, one or more GDs, an AS, a slot server (if different from the CS 400), another device, or a combination thereof. Further, some or all of the data described as being stored in the memory 415 may be partially or wholly stored (in addition to or in lieu of being stored in the memory 415) in a memory of one or more other devices. Such one or more other devices may comprise, for example, one or more peripheral devices, one or more GDs, an AS, a slot server (if different from CS 400), another device, or a combination thereof.

The processor 405 is also operable to communicate with one or more input devices 445. An input device may comprise any device operable to facilitate input to the CS 400 (e.g., input by a person, such as a keyboard or mouse). An input device, as the term is used herein, may be any device, element or component (or combination thereof) that is capable of receiving an input (e.g., from a player or another device). An input device may communicate with or be part of another device (e.g. an AS, a GD, etc.). Some examples of input devices include: a bar-code scanner, a magnetic stripe reader, a computer keyboard or keypad, a button (e.g., mechanical, electromechanical or "soft", as in a portion of a touch-screen), a handle, a keypad, a touch-screen, a microphone, an infrared sensor, a voice recognition module, a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port, and a weight scale. For example, in one embodiment an authorized person may use an input device 445 to program or re-program CS 400 to perform a function and/or to write data to one of the databases stored in memory 415.

The processor 405 is further operable to communicate with one or more output devices 450. An output device may comprise any device operable to output information from the CS 400. An output device, as the term is used herein, may be any device, element or component (or combination thereof) that is capable of providing or outputting an output (e.g., to a person or another device). Examples of an output device include, but are not limited to, a display (e.g., in the form of a touch screen), an audio speaker, an infra-red transmitter, a radio transmitter, an electric motor, a printer, a coupon or product dispenser, an infra-red port, a Braille computer monitor, and a coin or bill dispenser.

In some embodiments, CS 400 may comprise components capable of facilitating both input and output functions (i.e., input/output devices). In one example, a touch-sensitive display screen comprises an input/output device (e.g., the device outputs graphics and receives selections from an authorized person).

In embodiments wherein the tangible media comprises a DVD, such a disc may be formatted according to a DVD encoding process as is known in the art. For example, one or more media files may be segmented into "chapters" that are individually accessible by players. For example, a DVD having recorded thereon a video presentation of a 1,000-game play session may be segregated into 20 chapters of 50 game plays each that a player may watch. In another example, each media file (i.e., game play) may be encoded as its own chapter, such that a player may use an "enter" button of a DVD player remote control much like a "spin" button of a slot machine, launching each video presentation or segment of a video presentation much like actuating a game play of a slot machine. It should be noted that one advantage of such a DVD format of creating a video presentation is that many of the convenient navigation features associated with watching video using a DVD player may be harnessed. For example, a player may stop, pause, fast-forward or rewind the video presentation, or skip chapters entirely.

In embodiments wherein physical media comprises a CD-ROM, a video presentation may be incorporated into a software program that is executable by a purchaser of a session using a computing device. Thus, in some embodiments, creating a video presentation may comprise creating an executable software application. For example, creating a video presentation may comprise creating a software program that lets purchasers of sessions interact with the video presentation in a similar manner to a software application of an online casino using a home computer. For example, a purchaser of a session may insert a CD-ROM into an appropriate drive of a home computer, and then click on a graphic of a "spin" button when he desires to view another outcome (e.g., the software program written to the CD-ROM is operable to receive user input, and based on the input, access and display a stored media file as is known in the art). Various software applications that may at least assist in the creation of such DVD and CD-ROM discs may be available commercially. In some embodiments, the user receives data that represents the outcome and a software program, which may or may not be delivered on the same media as the outcomes, and which animate a video presentation.

It should be noted that, in some embodiments, the order in which media files are written to tangible media and/or stored electronically in a database or other memory structure may be immaterial (e.g., such that a player later viewing outcomes remotely may not necessarily watch them in the order in which they were generated). For example, media files of a video presentation may appear in a random order.

It should also be noted that, in some embodiments, a GD comprises a "simplified gaming device" or SGD. An SGD, as the term is used herein, may comprise a device operable to generate an outcome based on a random number but that is not designed to be located on a casino floor for interaction with a player. For example, an SGD may be programmed to perform functions different from that of a more conventional type of GD and/or to not perform some of the functions conventionally performed by a GD (e.g., display an indication of an outcome determined based on a random number). Further, a SGD may include components different from those normally included in a more conventional type of GD and/or fewer such components. For example, in some embodiments an SGD may not include a benefit output device and/or player tracking device. For example, in some embodiments Applicants envision that a plurality of outcomes for storage and sale via a DVD may be generated by a SGD that comprises a processor running in conjunction with an emulator of a wagering game, the SGD being located in a location other than a casino floor frequented by players. Such an SGD may not, for example, include a cabinet designed to attract a player and may not be operable to output coins, tokens or other benefits. Such an SGD may, however, be programmed to generate a large number of outcomes (e.g., substantially simultaneously) without displaying any of the outcomes so generated, which is unlike a conventional type of gaming device.

3. Databases

Various databases may be useful in one or more embodiments. One such database is shown in FIG. 5, which illustrates an example structure and sample contents of an available DVDs database 500. The specific data and fields illustrated in FIG. 5 represents only some embodiments of the records that may be stored in the database. The data and fields of such a database can be readily modified, for example, to include more or fewer data fields. A single database that is a combination of multiple databases, or a configuration that utilizes multiple databases may also be employed. Note that in the database 500, a different reference numeral is employed to identify each field. However, in at least one embodiment, fields that are similarly named (e.g., session identifier fields) may store similar or the same data in a similar or in the same data format.

As will be understood by those skilled in the art, the schematic illustration and accompanying descriptions of data contained in the sample database presented herein is an exemplary arrangement for stored representations of information. Any number of other arrangements may be employed besides those suggested by the table shown. For example, the embodiments described herein could be practiced effectively using more functionally equivalent databases. Similarly, the illustrated entries of the database represent exemplary information only; those skilled in the art will understand that the number and content of the entries can be different from those illustrated herein. Further, despite the depiction of the database as a table, an object-based model could be used to store and manipulate the data types of one or more embodiments and likewise, object methods or behaviors can be used to implement the processes of one or more embodiments.

FIG. 5 is a tabular representation 500 of an example embodiment of an available DVDs database 440 (e.g., as it may be stored in a memory of a CS 400 and/or in a memory of another device). Tabular representation 500 is referred to herein as available DVDs database 500.

The available DVDs database 500 includes a number of example records or entries, including records R500-1 through R500-5, each defining a DVD that is available for purchase or that was available for purchase. Those skilled in the art will understand that the available DVDs database 500 may include any number of entries. The available DVDs database 500 also defines fields for each of the entries or records. The fields specify: (i) a disc identifier 505 that uniquely identifies a DVD; (ii) a redemption value 510 that indicates a payment that may be provided to a player who purchases the corresponding DVD, upon redemption of the DVD; (iii) a price 515 to be paid by a player for the DVD; (iv) a date sold 520 that indicates a date and/or time on which the corresponding DVD was sold; (v) an activation code 525 that may be provided, in some embodiments, to a player upon the player purchasing the DVD; (vi) a player identifier 530 that identifies a player who purchases the corresponding DVD (in some embodiments DVDs may be purchased anonymously and this information may not be stored); and (vii) a status 535 of the DVD (e.g., an indication of whether the DVD is "available" for purchase or otherwise available to be provided to a player, has been "purchased" or otherwise provided to a player, or has been "redeemed" such that the redemption value of the DVD, if any, has been provided to a player).

The available DVDs database 500 may be utilized, for example, to track DVDs available for purchase at a casino. For example, as a DVD is provided by AS 310 or otherwise made available for sale or other provision to a player, a new record may be created in the database based on the unique DVD identifier of the DVD. The redemption value associated with the DVD may also be recorded in the newly created record (e.g., the redemption value that corresponds to the DVD identifier may be received from AS 310). The status of the DVD may be set to "available."

In one embodiment, the available DVDs database 500 may be utilized again when a player requests to purchase a DVD. For example, the database may be queried based on the DVD identifier on the packaging of the DVD that the player desires to purchase. This may be initiated by a casino attendant, for example, who also inspects a tamper evident item associated with the DVD which will be described below. It may be verified that the DVD has not previously been purchased, based on the status 535 associated with the DVD in the database. Further, an activation code may be determined (e.g., by CS 305, which may generate or select an activation code for each DVD as it is sold via a POS 320) and the activation code may be recorded in the appropriate record of the available DVDs database. For example, POS 320 may communicate with CS 305 in order to determine the activation code and verify that the DVD is available for purchase.

It should be noted that an activation code may, in some embodiments, be necessary to activate a DVD (e.g., the player may be required to input the activation code when inserting the DVD into a DVD player). In other embodiments, the activation code may only be necessary for redemption of the DVD but not for viewing the video presentation of the DVD. The activation code may also be printed on a receipt such as a wagering game receipt that may be provided to the player at the time of purchase of the DVD, or otherwise provided to the player upon the DVD being provided to the player in a legitimate manner.

In some embodiments, a DVD may be encoded with an activation code that is required before the video presentation stored on that game disc can be accessed and displayed. For example, some DVDs containing movies thereon currently include region codes that prevent those DVDs from being played on a DVD player that was sold in a country other than that in which the DVD was released. The DVD player has a region code stored in its firmware, and the code stored on the DVD must match the DVD player code to enable that DVD player to play the movie. Movie studios use such region code protection to thwart unauthorized duplication of their copyrighted material and to control the worldwide release dates of their movies released on DVDs. Similar technology could be implemented in DVD players or other tangible medium player devices that include software, for example, that requires input of an activation code before a game disc could be played. The activation code may be provided to a player at the point of sale and then, when the player later attempts to view the game disc, the player may be prompted to input the activation code to the playing device by using, for example, a remote control or keyboard. In some implementations, the player may use a DVD-ROM drive connected to her PC to view a game disc. Before any outcomes are shown, the PC prompts the player to input the activation code which is then transmitted, for example, over a network (such as the internet), or via a secure line, to a CS (or, in another example, to the game disc manufacturer's server) and compared to a database of activation codes. If a match occurs, then the game disc outcomes are unlocked to enable the gaming outcomes to be displayed to the player. If the activation code provided by the player does not match the code stored in the database, then an error message may be displayed.

The available DVDs database 500 may be accessed yet again when a player attempts to redeem a DVD (e.g., collect the redemption value associated with the DVD). For example, as described in detail herein, it may be verified that the DVD was legitimately purchased and that the DVD has not previously been redeemed (e.g., the status associated with the DVD is "purchased"). The payout information (and perhaps the DVD price information) may then be transmitted to a casino representative, for example, so that the player can collect her prize or award.

4. Processes

Figure 6:
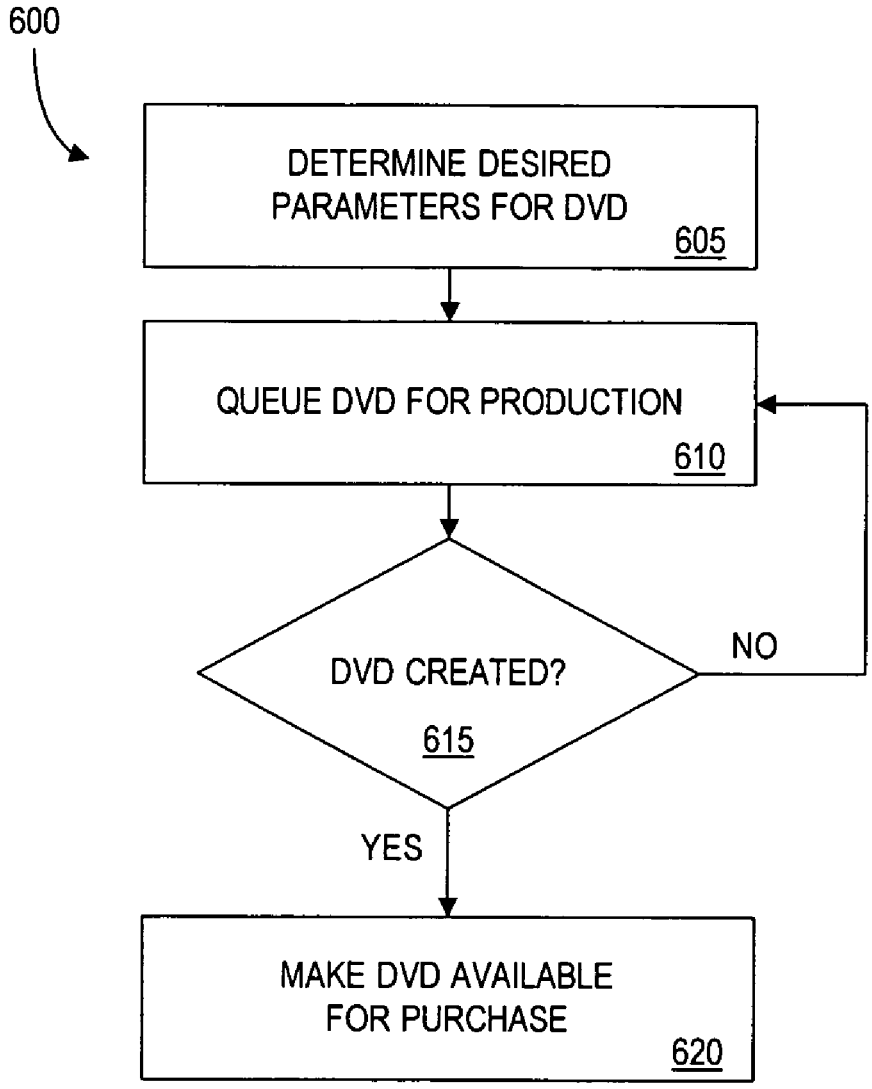
FIG. 6 is a flowchart of an example process for creating a DVD, according to some embodiments described herein.

FIG. 6 is a flowchart of an example process 600 for creating a DVD. The process 600 is meant as an overview of the process of creating a DVD and does not include many detailed steps or sub-routines that may be involved in such a process. Several figures that follow illustrate more detailed example processes for creating, selling, and redeeming a DVD.

Referring to FIG. 6, step 605 provides for determining the desired parameters for a DVD to be created. For example, an order for a DVD and/or session result data may be received. In one embodiment, some or all of the information in a session database 425 may be communicated in step 605 as an indication of the parameters of the DVD to be created.

Examples of parameters that may be determined in step 605 include, without limitation, (i) a price of the DVD (which may, in some embodiments, be the starting credit meter balance of the session based on which the DVD is to be created; (ii) a game; (ii) a gaming device; (iii) a casino; (iv) a payout schedule; (v) a strategy to be employed in making decisions on behalf of a player; (vi) an ending credit meter balance; (vii) one or more intermediate credit meter balances; (viii) a number of game plays or outcomes to be represented; (ix) a wager per game play; (x) outcomes to be represented; (xi) an order of outcomes to be represented; (xii) advertisements, promotional or other material to be included in the video presentation to be included on the DVD; (xiii) audio to be included on the DVD; (xiv) a language preference in which the material in the DVD is to be presented; and/or (xv) one or more payouts to be represented on the DVD. It should be understood that some of the above items may be redundant with other items. It should further be understood that not all of the above-listed parameters are required to be known in order to create a DVD.

It should still further be understood that, in some embodiments, some of the parameters (and values thereof may be determined by a first device (e.g., CS 305) and transmitted to a second device (e.g., AS 310) performing step 605, while other parameters (and values thereof may be determined directly by the second device. The second device may determine such additional parameters (and values thereof, for example, based on information received from the first device and/or based on a program or instructions stored in a memory of the second device.

In other embodiments, all of the parameters (and values thereof may be determined by the first device and transmitted to the second device, the second device having minimal processing capabilities and merely serving to assemble the video presentation and record it onto a DVD.

In step 610, the DVD is queued for production. For example, a record may be created in a DVD production queue. For example, a unique disc identifier may be determined and used to create a new record. At least some of the parameters determined in step 605 (and values thereof) may be stored in the record. The disc identifier may be placed in a DVD production queue. A device for producing the DVDs (or at least the device performing a first step in the production process), such as AS 310, may select the DVDs to be created on a first-come-first-serve basis (e.g., based on the order submission time, based on the disc identifier, etc.).

In step 615 it is determined whether the DVD has been created. For example, it may be determined whether a record for the DVD in a DVD production queue database indicates that the production process for the DVD has been completed. In a more particular example, a DVD production queue database may be accessed to determine whether there is an entry in a production completed time field.

If it is determined that the DVD has been created, the DVD is made available for purchase in step 620. For example, the DVD may be packaged to include at least one tamper evident item, and then shipped as one of a plurality of DVDs intended for a particular destination (e.g., a particular casino that may be identified in a database) and shipped to the destination. Otherwise, the process 615 loops until it is determined that the DVD has been created.

In one embodiment, a secure facility may comprise one or more GDs for producing game play results (e.g., MGDs that generate game play results in an automated fashion, with little or no human involvement). Additionally, such a facility may comprise various hardware and software for producing DVDs based on the results generated by the GDs. For example, an "assembly line" of computerized and/or mechanized devices may be configured to (i) store appropriate media content on DVDs based on game play results generated by the GDs, (ii) label such DVDs, (iii) package such DVDs (e.g., including adding barcodes, graphics, tamper evident items, insert the DVDs into jewel cases, etc.) and/or (iv) shrink-wrap such packaging. Thus, such a facility may comprise a variety of devices, one or more of which may communicate with one or more databases for determining necessary information for producing such DVDs.

For example, each DVD may be unique (e.g., the game play results thereof may be based on a session generated for that particular DVD), and therefore when producing each DVD, it may be necessary for various devices to communicate with one or more GDs (or otherwise obtain data generated by one or more GDs) and/or databases so as to determine appropriate content for the DVD. For example, an assembly unit may comprise a computer system in communication with a mechanized or robotic arm that accesses physical media (e.g., lifts a "blank" DVD from a spindle of DVDs and places it into an area in which the DVD may subsequently be written to by an optical device). The computer system may also be configured to instruct an optical device to encode the DVD with various content (e.g., indications of game play results, a menu interface, etc.). The computer system itself may or may not generate the game play results that are used to determine the content for the DVD. Accordingly, the assembly unit (e.g., the computer system in communication with the mechanized hardware, optical device, etc.) may communicate with one or more devices and/or databases that store session results and/or media files for creating a video presentation to be recorded onto a DVD. It should be understood that one or more sets of DVDs, wherein each set includes a plurality of DVDs, may be manufactured. Each DVD of a set contains the same wagering game outcomes (or the same session), and upon purchase of the DVD the purchaser receives a wagering game receipt, for example, that specifies which outcome or outcomes of the session on that DVD correspond to a payout, if any.

In some embodiments, a facility for producing DVDs may further be configured to uniquely mark the packaging or labeling of such DVDs with one or more identifiers or codes. For example, a session identifier, player identifier, and/or activation code may be uniquely marked on the packaging or labeling of a DVD, such that the code or identifier may be used to facilitate various steps described herein with respect to the sale, activation and redemption of such DVDs. Thus, in one example, after a DVD has been uniquely encoded with content by a first assembly unit, the DVD may then be transferred to one or more second assembly units that may assist in the labeling and/or packaging of the DVD. For example, a second assembly unit may comprise a computer system in communication with various hardware for applying graphics or other labeling to the top side of a DVD (e.g., a pressing unit applies permanent color or grayscale images to the top side of the DVD). Such a unit may then communicate with one or more databases, such that one or more identifiers associated with the DVD may then be determined (e.g., a "Disc Activation Number"). In one embodiment, a master computer system may keep track of each DVD's position within a series of assembly units, such that when a DVD reaches a second assembly unit, the unit may be instructed to label the DVD with one or more identifiers. In another example, the unit may determine an identifier by reading the DVD (e.g., if the DVD was previously encoded with an identifier). In either case, the identifier may then be marked upon the DVD. In some embodiments, the identifier may be machine-readable (e.g., a barcode is labeled upon the top of the DVD). Alternately or additionally, a human-readable identifier may be labeled upon the DVD (e.g., a numeric code is imprinted). In some embodiments, the labeled and encoded DVD may then be transported to one or more further assembly units. For example, yet another assembly unit may be responsible for inserting the DVD into a jewel case, for associating one or more tamper evident items with the DVD, and/or for shrink-wrapping a jewel case, etc. Other processes such as printing packaging materials (e.g., paper inserts or other paper materials that accompany jewel cases) may or may not take place in such a facility. For example, in one embodiment, a separate press may receive instructions for imprinting a paper cover to be inserted into a jewel case with graphics and a unique identifier (e.g., associated with a particular DVD). The paper cover may then later be merged and/or otherwise incorporated into such an assembly process (e.g., the cover is matched to a jewel case containing the appropriate DVD).

It should be noted that various efforts may be made to ensure that the production of video presentations and/or DVDs on which such video presentations are recorded in such an automated facility occurs without tampering. For example, such devices and/or various components thereof may be equipped with items and/or devices that indicate whether physical tampering has occurred (e.g., the casing of a device for generating game play results may include a tamper-evident seal). In other embodiments, a central computer or server may authenticate or verify that the software of a device has not been tampered with, via a checksum or one or more other such authentication procedures known in the art.

In some embodiments, to help ensure fairness of production of DVDs, an operator of a system producing DVDs and/or video presentations may certify a payback percentage for an aggregate number of DVDs (e.g., DVDs are produced in a manner such that for every 1,000 DVDs made, the 1,000 DVDs will on average pay out a certain sum to customers). In some embodiments wherein a set of DVDs (wherein the set may comprise 1000 DVDs, for example) all contain the same session, the payback percentage for the set may be certified and the wagering game receipts provided to players when they purchase a DVD may then be printed in such manner that the guaranteed payback percentage is met. It should be appreciated that methods for auditing such claims are well known in the art (e.g., much as how a slot machine payback percentage is audited).

Figure 7:
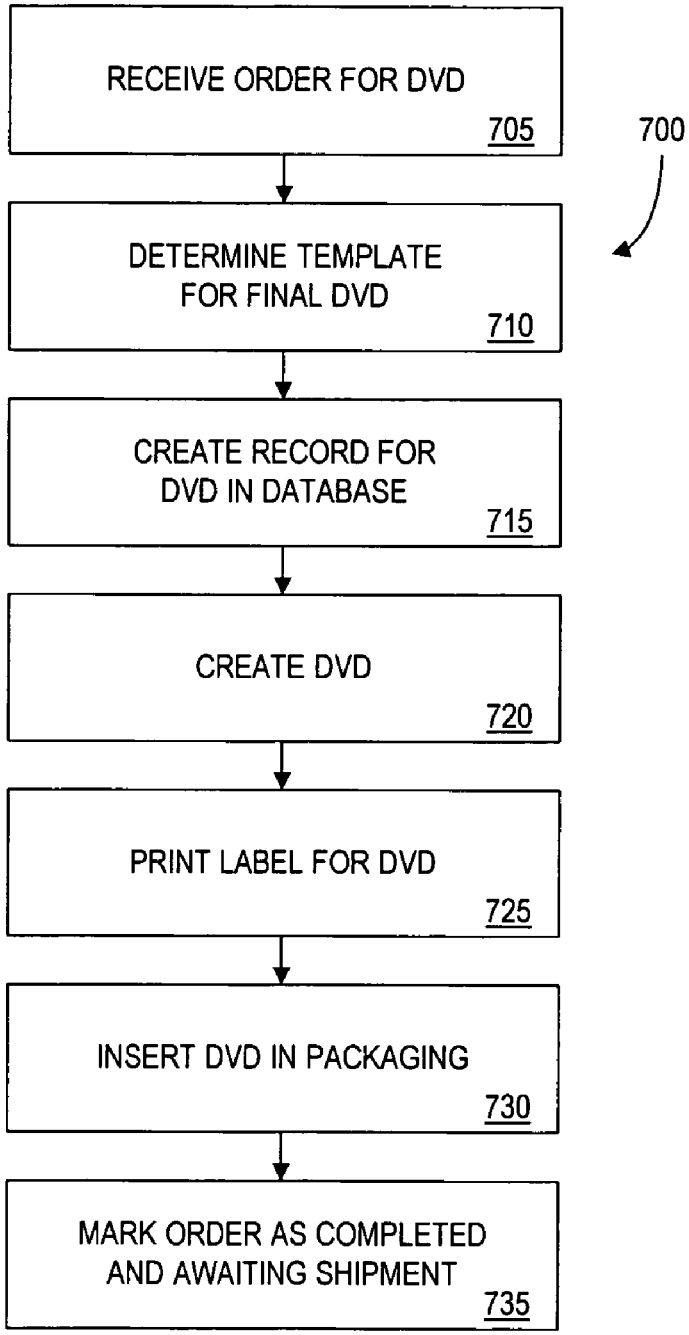
FIG. 7 is a flowchart of an example process for determining processing an order for a DVD, in accordance with some embodiments described herein.

FIG. 7 is a flowchart of an example process 700 for creating a DVD. In step 705, an order for a DVD is received. For example, an order from a casino for a plurality of DVDs may be received electronically and/or via paper or other tangible medium. For example, a casino or other customer may transmit session result data for a plurality of sessions, thus ordering a DVD corresponding to each of the sessions. In some embodiments, an order may specify that a plurality of DVDs be created based on session result data for a particular session. In one example, the session result data of an order may be transmitted to AS 310 electronically or be called in by a casino representative. In another example, a document corresponding to one or more of the sessions may be received. For example, as described herein, in some embodiments one or more session results tickets may be printed by a GD for a session executed by the GD. In one embodiment, step 705 may include receiving the session results tickets (or copies thereof) for each session included in the order. In some embodiments, each session may be received as a separate order.

In step 710 a template is determined for the final DVD. As would be understood by one of ordinary skill in the art of producing DVDs, a template for a DVD may include an indication of information to be included in the DVD and may include items that are constant across a batch of DVDs. A template may further include programming commands (pause here, skip to there if this button is pushed, etc.) for manipulating the assets (i.e., content) of the DVD. In some embodiments, the same template may be used for all DVDs of the same game, casino, number of game plays and wager per game play. Thus, there may be a plurality of templates stored in a memory (e.g., a memory of AS 310) and step 710 may comprise selecting the appropriate template for use, based on the session result information determined in step 705. A particular template may include, for example, an opening menu design, buttons, graphics, and advertising material. In some embodiments, some of the data in a template may be variable (e.g., a first advertisement may be selected for inclusion in an advertising portion of a first DVD while a second advertisement may be selected for inclusion in an advertising portion of a second DVD).

In step 715, a record for the DVD of the order is created in a database such as a DVD production queue database. A record in the DVD production queue database may be created based on the receipt of the order. For example, a unique order number may be determined (e.g., the order number may be received as part of the order or assigned to the order upon the order being received) and stored in the newly created record. The customer identifier for the order may also be recorded. A disc identifier may be determined and stored as well. Additional information regarding parameters of the DVD to be created may also be determined from the session result information of the order and stored in the record (e.g., game brand, casino, denomination, wager per game play, payout schedule, number of game plays, starting credit meter balance, end credit meter balance, session identifier). The order submission time (e.g., the time at which the order was received) may also be stored.

In step 720, the DVD is created via a production process that may comprise one or more steps. The steps may comprise, for example, creating a video presentation to be recorded onto the DVD, and recording the video presentation onto the DVD. In some embodiments, as a DVD proceeds through a production process having several steps, the appropriate record of the DVD production queue database is updated upon the completion of each step, to track the progress of the DVD creation.

In step 725 a label is printed for the DVD. This may involve, for example, determining a graphics image and printing it onto the label or onto the DVD itself. The label may further include unique information such as a unique disc identifier or a session identifier. In some embodiments, the label may include an indication of the game and/or casino represented in the video presentation of the DVD.

In step 730 the DVD is inserted into packaging. The DVD may be packaged such that tampering with the DVD (e.g., unauthorized opening of the DVD) is visible or otherwise easily discernable by a casino representative, for example, as will be explained below.

In step 735 it is determined that the DVD has been successfully created and the order is marked as ready for shipment. For example, a production completed time field in a database may be updated to reflect the time at which the production process was completed, thus marking the DVD (or record of the DVD) to reflect that the DVD is ready for shipment.

Pre-Packaged Discs and Security

In some embodiments, it may be advantageous for a casino to place pre-packaged game discs in various locations throughout a casino floor, such that should a player wish to purchase a disc, all the player need to do is pick up a disc and bring the disc to an appropriate location within the casino and provide payment. The disc may then be activated as described. Such embodiments may also be advantageous, for example when pre-packaged discs are maintained behind counters or in some other manner that mitigates the ability of players to purchase the discs on impulse.

Thus, as described previously, discs must be activated before they are redeemed, and an activation code or validation code that is provided when the DVD is purchased (e.g., a "Prize Claim Code" or a "wagering game receipt") must be presented for a player to collect any winnings associated with the disc (e.g., discs are worthless unless they are activated, and to be activated, payment must be provided). In this manner, theft of discs by casino patrons may be deterred or even prevented altogether, as patrons may understand that payment must be provided in one form or another in order for winnings to be claimed.

However, it is foreseen that various other fraudulent attempts to claim winnings associated with pre-packaged discs outside of theft may arise. For example, if a player were somehow able to view (i) game result data and/or (ii) indications of game results associated with a plurality of pre-packaged game discs (e.g., the player is able to view a plurality of discs before deciding to purchase one or more of the discs), the player may be able to determine which discs may be profitable (e.g., yield a final credit balance that is larger than the flat price associated with the disc) before purchasing the discs. Accordingly, the player may attempt, after viewing a plurality of discs, to purchase only the discs that are known to be profitable, discarding the others or otherwise leaving them unsold. Such a practice may clearly have negative implications on the ability of a casino to offer such discs in a profitable manner (e.g., as a casino may be forced to pay out large amounts of winnings without collecting sufficiently overriding revenues from the sale of the discs that do not pay out large amounts or do not pay out any amount). Accordingly, various embodiments of deterrent measures are contemplated for (i) restricting player access to game result data used for creating one or more game discs, and/or (ii) determining whether or not a player has performed any action that may constitute an attempt to view a game disc, and if the player has viewed or attempted to view the disc, making the disc unavailable for purchase.

Various methods are contemplated for restricting player access to game result data used for creating one or more game discs. For example, one or more devices used to generate such game results, or used to create one or more game discs based on such game results (e.g., determine and/or output indications of game results), may be maintained or secured in a manner such that players (or, for that matter, other persons) may have difficulty gaining access to such devices (e.g., without proper clearance). For example, one or more of such devices may be stored in a room that only authorized personnel may access (e.g., persons with appropriate keys, entry codes, etc.). In another example, such devices may be housed in a secure case, safe, or the like. Further, in some embodiments, such devices may include various tamper-evident objects. For example, as described, a device may include a tamper-evident seal that reveals whether or not the device (e.g., or case thereof) has been opened. In one specific example, security tape (or a "security sticker," "security label," and so on) may be adhered to a device in such a manner that the tape must be removed in order to gain access to the device's internal components. However, such security tape may reveal a tamper indication if it is removed (or, in some instances, attempted to be removed). For example, if such tape is peeled, or is exposed to extreme heat or cold, such tape may reveal the word "opened" (e.g., on the tape, on the object it is attached to, or both), indicating that the tape has been tampered with. One example of such tape, SECURE TRAC, is produced by Switched On I & T Services of Braeside, Victoria, Australia.

A variety of methods for determining whether or not a player has performed any action that may constitute an attempt to fraudulently view a game disc are also contemplated (e.g., thereby making the disc unavailable for purchase/activation). For example, in one or more embodiments, a tamper-evident seal may be adhered to the back side (i.e., readable side) of a game disc. Such a seal would ideally be characterized by several properties: (i) the seal may be adhered to the back of the disc in a manner such that it may not be removed unless such removal is desired (e.g., the adhesive property is strong enough that the seal doesn't "fall off" without being voluntarily removed by a person); (ii) the seal may be adhered to the back of the disc in a manner such that if the seal is removed, the disc may still be readable by an optical device (e.g., residue from any adhesive from the seal does not corrupt the disc or render it unreadable); (iii) when the seal is attached, the disc may not be readable (e.g., the chemical composition of the seal is such that an optical laser of a reader device such as a DVD player may be incapable of reading the disc while the seal is attached); (iv) once the seal is removed, it is (a) difficult to reapply to the disc (e.g., upon being removed, the seal loses its adhesive property), (b) difficult to reapply to the disc without altering the seal in such a manner that it becomes discernable by the naked eye that the seal was removed and re-adhered (e.g., the removal of the seal alters or distorts the seal such that it may become difficult to smoothly and uniformly reapply the seal), (c) discernable by the naked eye that the seal has been removed (e.g., a tamper-evident indicator is activated such that a property of the seal changes).

Figure 8A:
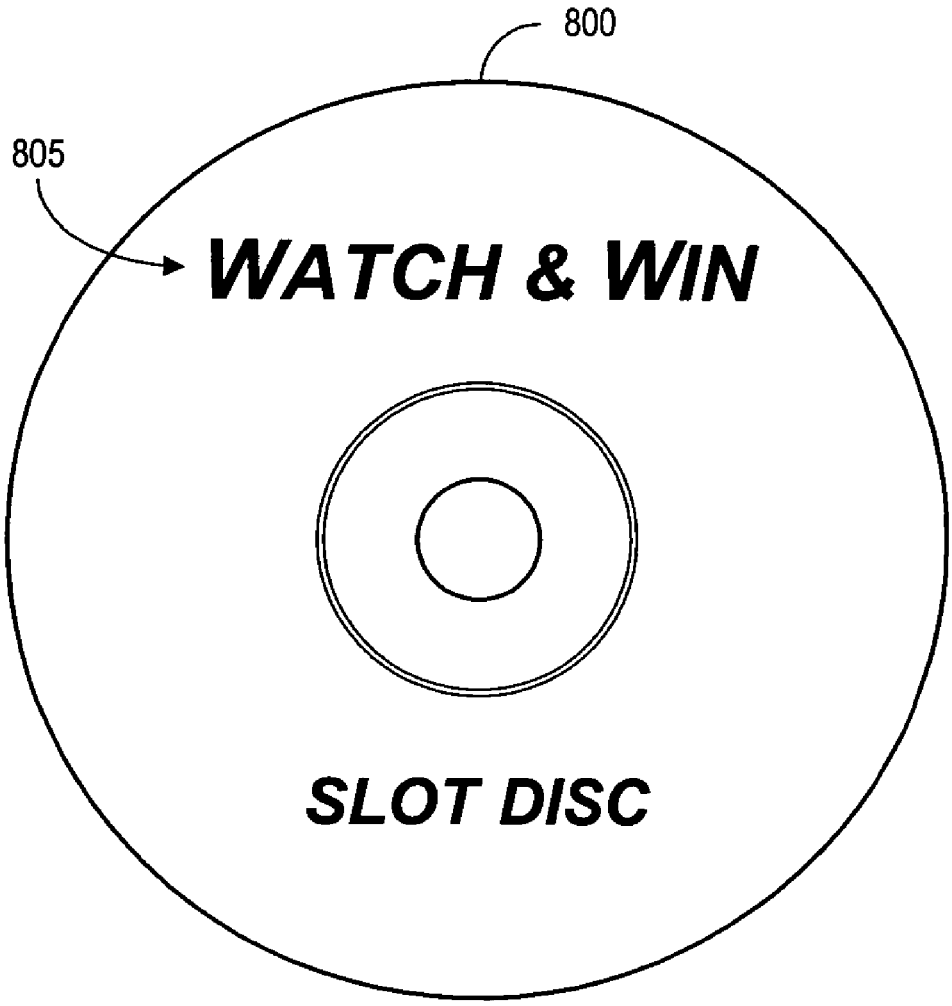
FIG. 8A is an example of a game disc, which may be a DVD.
Figure 8B:
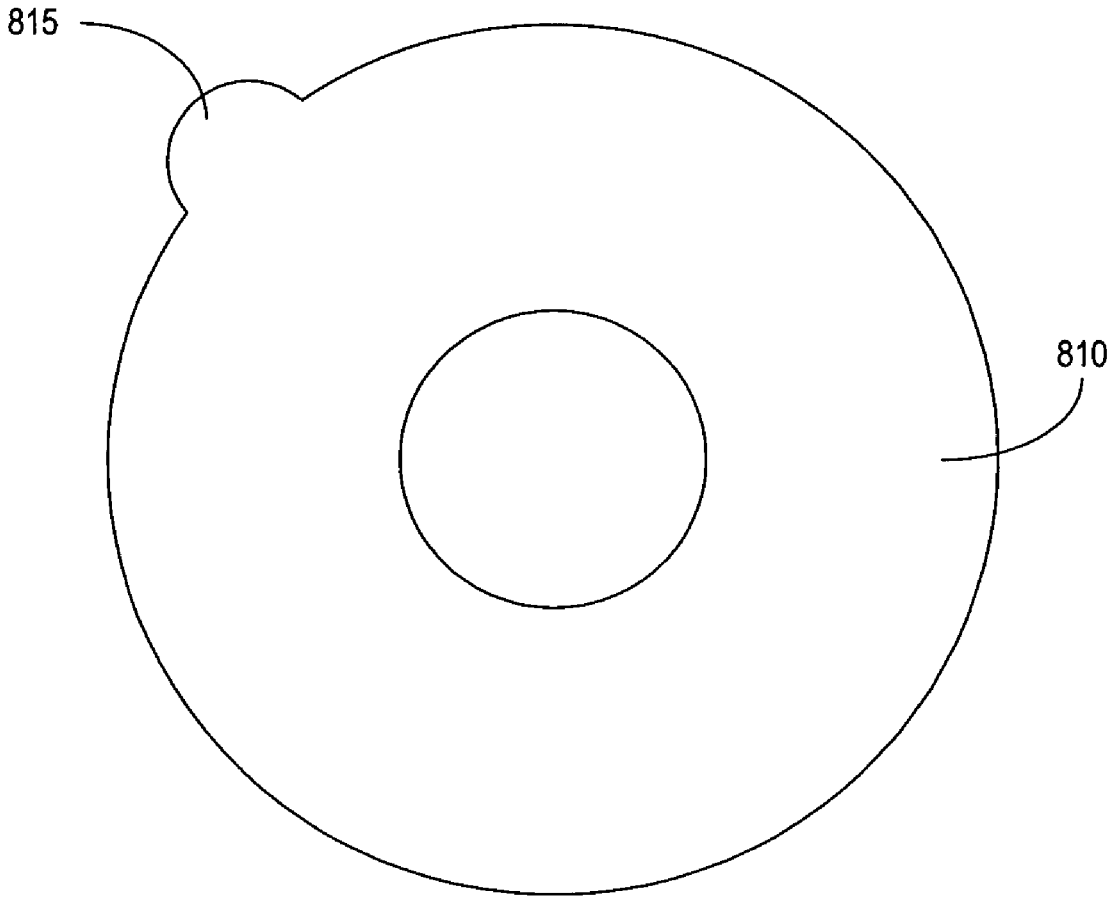
FIGS. 8B and 8C illustrate a static-cling seal with a tab and a static-cling seal with a barcode, respectively, for use with the game disc of FIG. 8A.

FIGS. 8A and 8B show a game disc 800, which may be a DVD, for example, and a static-cling seal 810 (or "static adhesive seal," or "static cling decal," or "static cling label," and the like). The DVD 800 may include graphics and/or other game descriptive markings on the front or top side (which may be a non-readable side) thereof. In some embodiments, the static-cling seal 810 may be applied to the rear or back or bottom (i.e., readable) side of the disc 800. Such a seal may, in some embodiments, be comprised of vinyl, polyester or a variety of other materials or combinations of materials such that the seal may inhibit the ability of an optical reader device or other type of reader device to read the disc while the seal is attached. Further, the seal may be adhered in a variety of manners. In one example, the seal 810 may be constructed of a material that adheres to a disc by way of natural static cling, without the need for a tacky adhesive that may leave behind a sticky residue or otherwise corrupt a readable side of a disc. A variety of materials for producing such static cling decals or seals are commercially available (e.g., "window decals" as are known in the art). Of course, in some embodiments, game discs 800 may comprise two readable sides, and thus two seals may be used. Further, in some embodiments, such seals may include a tab 815, to enable easy removal of the seal when the player wishes to use the disc. It should be noted that the tab 815 may also function to inhibit the ability of an optical reader device to read a game disc such as DVD 800 while the seal 810 is attached (e.g., the tab 815 prevents the disc from spinning at an appropriate, uniform speed within a reader device such as a DVD player).

Figure 8C:
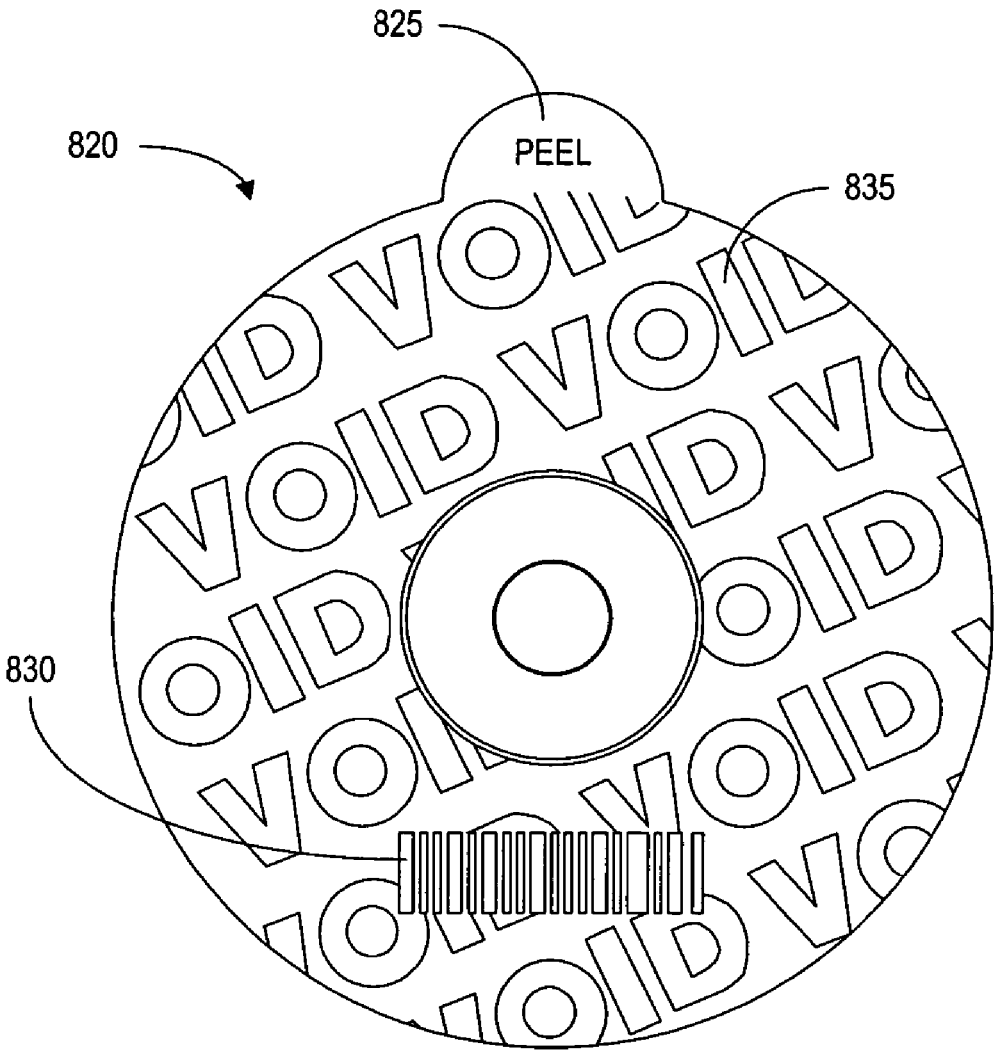

FIG. 8C is an embodiment of a tamper-evident static-cling seal 820 that includes a tab portion 825 and a barcode 830. In some embodiments, such a seal may be tamper-evident at least in part because upon removal of the seal from either a readable side or a non-readable side of a game disc, one or more properties of the seal are altered such that a tamper indication 835 is revealed. In this example, upon removal of the seal 820 from the disc (e.g., exposure of the adhered side to air, removal of a thin layer of the seal, etc.), the word "VOID" in text and/or graphics appears in a repeating pattern which indicates that the seal has been removed (other words such as "REMOVED," "INVALID," "WARNING," and the like could also be used.). Of course, various other properties of the seal may change such that a visual indication of tampering is evident, and in response to a variety of other triggers (e.g., actions other than removal of the seal). For example, rather than display text, a color associated with a seal may change. Moreover, exposure to heat, cold, humidity, pressure, or moisture may trigger one or more changes. A variety of commercially available tamper-evident labeling technologies may be used in the creation of such a seal. For example, Brady Identification and Safety Solutions of Sydney, Australia, manufactures a B-7566 tamper-evident seal which reveals the word "VOID" upon removal of the label, and similar technology may be used in producing a tamper-evident seal for the purposes described herein.

Referring again to FIG. 8C, the seal 820 includes a barcode 830. Such a barcode 830 (which may incorporate dense symbology and/or microprinting technology) may encode an identifier associated with the game disc and/or gaming contract or session associated with the disc, and/or game result data associated with the disc (e.g., a final session balance or a final credit balance), and so on. Thus, in an embodiment, a representative may scan the barcode and remove the seal to activate the disc. As described, in some embodiments, a validation code or activation code may then be determined and output (e.g., a purchase receipt or wagering game receipt indicating a "Prize Claim Code" and/or other information is output via a printer device) based on the received identifier. Further, printing or labeling such a seal with a barcode may further have a security benefit because once the seal 820 is removed, it may become difficult or impossible to scan and/or to read the barcode (e.g., if the seal is relatively flimsy or malleable in nature, then when it is removed the seal may distort or tear such that the barcode becomes crooked, cracked, distorted, or otherwise unreadable). Consequently, if the barcode is required to activate the disc, it may be impossible or difficult for players to fraudulently view such discs without first having them activated by a cashier at a POS, for example.

Figure 9A:
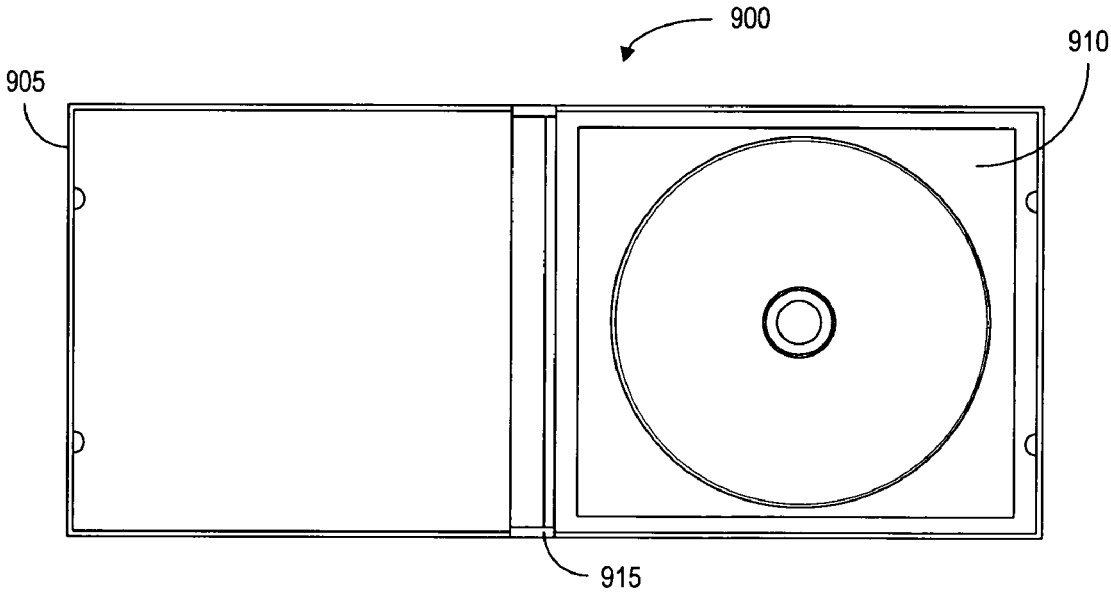
FIG. 9A and FIG. 9B illustrate a top view and a side view, respectively, of a jewel case in opened positions.
Figure 9B:
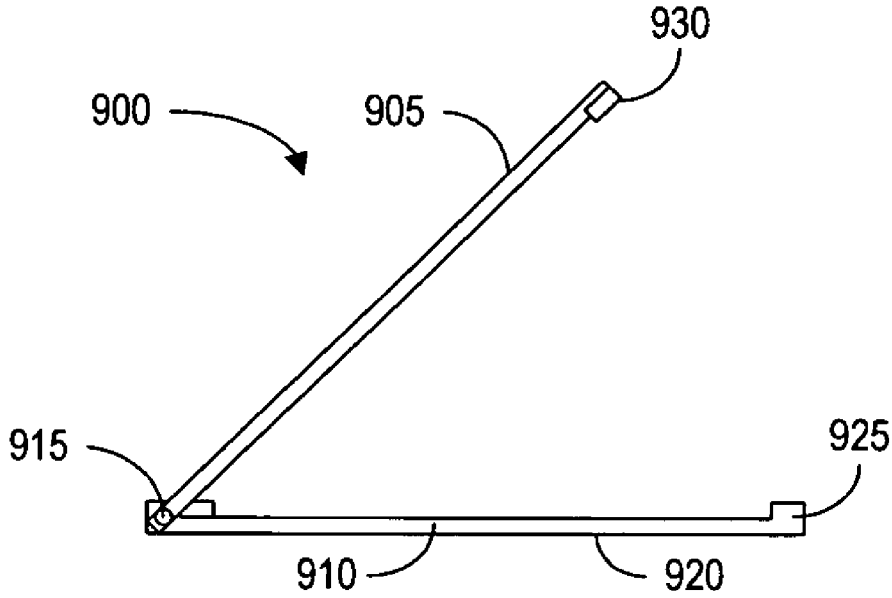

FIG. 9A is a top view and FIG. 9B is a side view of a jewel case 900 in two different opened positions. The jewel case 900 may be used to house a game disc, such as a DVD 800 or a CD-ROM, for example. The jewel case 900 includes a top face or cover 905 that typically is made of a transparent material, and a tray 910 for seating a tangible medium such as DVD 800. The tray 910 may be made of a durable plastic, rubber, metal, a composite, or other material (e.g., cardboard or another paper compound). The cover 905 rotates about a hinge 915 when opening or closing the jewel case 900, and when in the closed position covers and protects the DVD seated in the tray 910. In some embodiments, wherein a jewel case is made of cardboard or another paper compound, hinge 915 may simply be a fold in the packaging such that a cover may be folded over the tray portion 910 of the jewel case. Referring to FIG. 9B, the tray 910 has a backside 920 that may be transparent or opaque, and includes an edge portion 925 configured to mate with an edge 930 of the cover 905. Tabs or other snap-fit connector components (not shown), for example, may be included on the edge portions 925 and 930 or on other edges of the cover 905 and/or the tray 910, for use in removably connecting the cover and the tray together when the jewel case 900 is in a closed position.

The jewel case 900 may itself include a tamper-evident seal on one or more outside surfaces, and may include a transparent portion so that the tamper-evident seal on the DVD may be visible. The transparent portion thus makes it possible to determine whether or not the seal on the DVD seated on the tray has been tampered with without opening the jewel case and without removing the disc from the packaging. For example, in one or more embodiments, at least a portion of the back side 915 of the jewel case may be comprised of transparent (e.g., clear) plastic, such that the bottom side of a game disc 800 placed inside the jewel case may be visible to a cashier or other person without the need to remove the disc from the jewel case. The jewel case may also be shrink-wrapped in a transparent plastic covering. In this case, it would be possible for the cashier to observe whether or not a tamper-evident seal affixed to the game disc has been removed or altered without having to open the jewel case and remove the disc.

In an embodiment, a jewel case or portion thereof (e.g., the backside 915 of the case) is made of transparent or clear plastic, and various marketing materials (e.g., made of paper, cardboard, plastic, etc.) may be affixed thereto. The marketing materials may include various text and/or graphics information that promotes game discs, or promotes the particular wagering game on that DVD, or provides instructions to players, and the like. Such marketing materials may be affixed to the back of such a jewel case in a manner such that at least a portion of a game disc 800 may still be viewable through the clear plastic of the jewel case 900. FIG. 9C illustrates an example of "marketing material" 950 that may be inserted into the jewel case 900. The marketing material 950 includes promotional material 960 which may include graphics, instructions and the like, and that is positioned to be visible through a transparent face 905 of the jewel case 900. In the example shown in FIG. 9C, a large portion of the readable side of the game disc, and the game disc barcode, is visible through a transparent portion 955 of the backside wall of the jewel case. It should be understood that the jewel case 900 may be manufactured in various proportions or dimensions other than the dimensions indicated in FIGS. 9A to 9C (e.g., the size of the case may be longer, wider, and/or thicker). In addition, the case may be manufactured to have other shapes, such as round, oblong and the like.

Figure 10A:
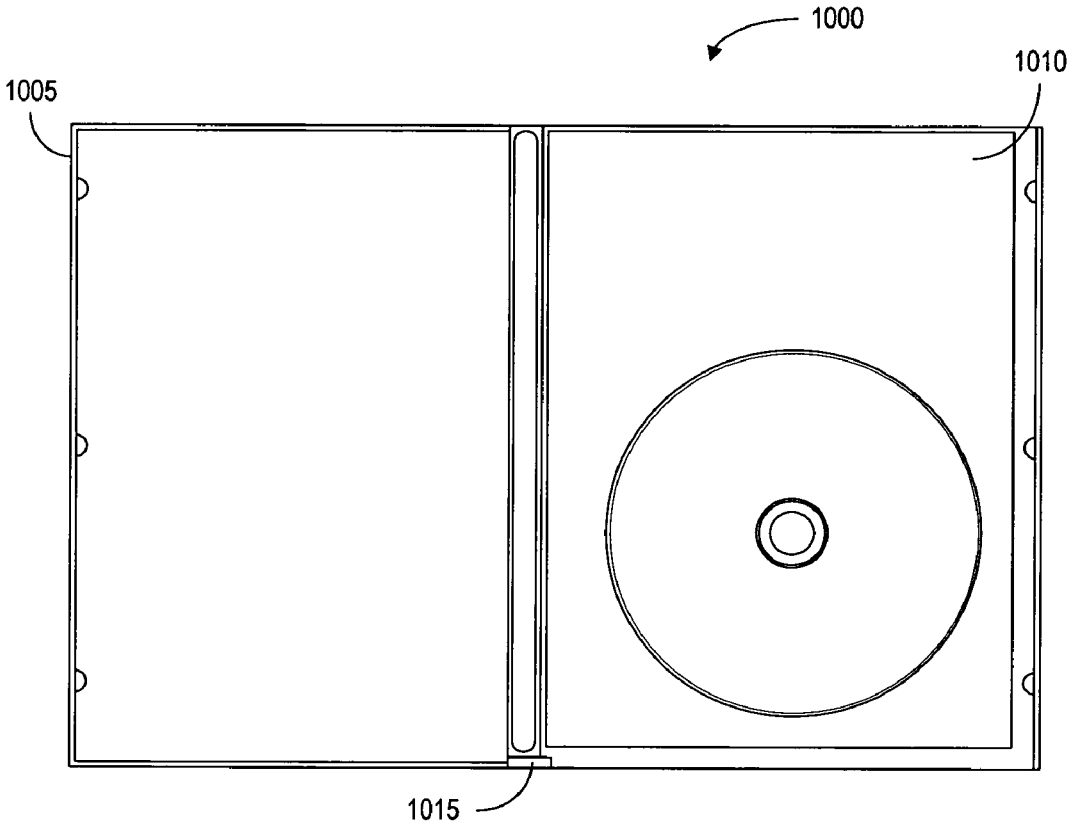
FIGS. 10A and 10B illustrate a top view and a side view, respectively, of a DVD case in opened positions.
Figure 10B:
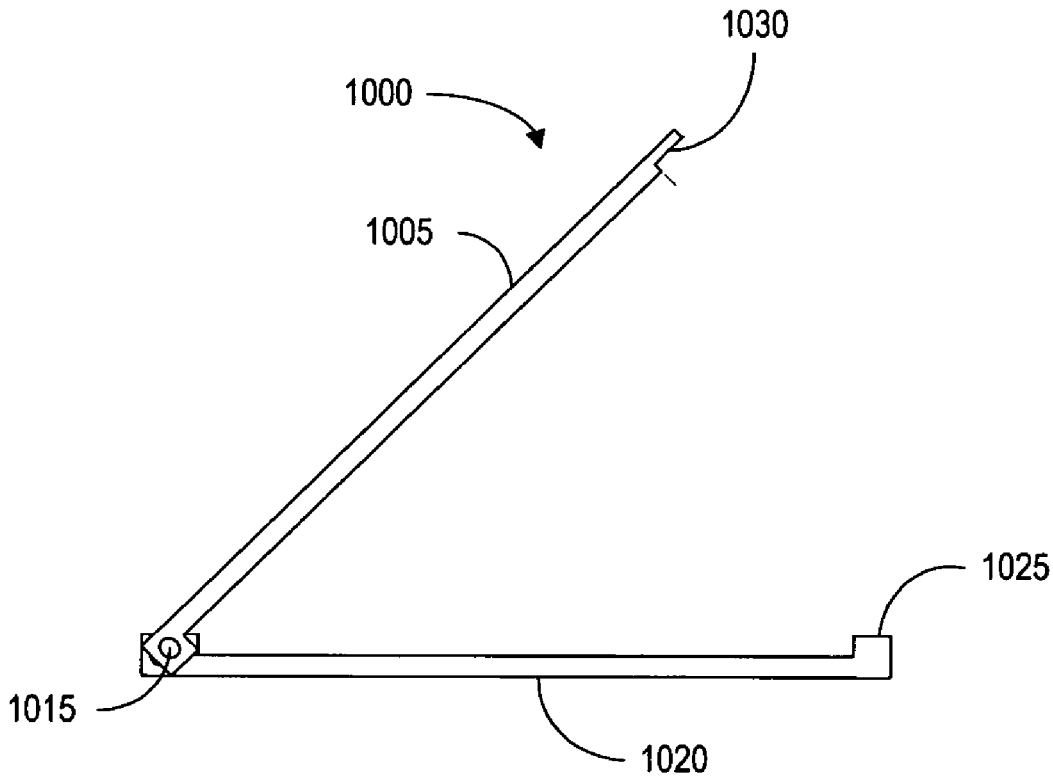

FIGS. 10A and 10B illustrate a top view and a side view, respectively of a DVD case 1000 in two different opened positions. The DVD case 1000 may be used to house a game disc, such as a DVD 1000 or a CD-ROM. The DVD case 1000 includes a top face or cover 1005 and a tray 1010 for seating a tangible medium such as a DVD or CD-ROM. In the embodiment shown, the cover 1005 rotates about a hinge 1015 to open and to close the DVD case 1000. When the cover 1005 is in the closed position, it protects the DVD seated in the tray 1010. Referring to FIG. 10B, the tray 1010 has a backside 1020 that may be transparent or opaque, and that includes an edge portion 1025 configured to mate with an edge 1030 of the cover 1005. Tabs or other snap-fit connector components (not shown), for example, may be included on the edge portions 1025 and 1030 or on other edges of the cover 1005 and/or the tray 1010, for use to removably connect the cover and the tray together when the DVD case 1000 is in a closed position.

The cover 1005 and the tray 1010 may be made of a durable plastic, rubber, paper, cardboard, metal, fiberglass, a composite, or other material. For example, the case may be a folded cardboard package having a recessed portion for housing the tangible medium, such as a DVD. In addition, other types of packaging, such as paper or plastic slipcovers, pockets, or housings of other design, could be utilized to encase and protect the gaming disc as desired. For example, a star shaped plastic sleeve could be used to house game discs, which shape could function to distinguish the DVD contained therein from being associated with a movie or a recording of a television show. It is also contemplated that special or custom designed packages and associated marketing materials may be used, for example, to commemorate special events such as anniversaries, weddings, parties, and/or other celebrations.

In one or more other embodiments, a game disc such as the DVD 800 may be chemically treated in such a manner so as to inhibit a player's ability to attempt to view indications of game results without such an attempt being discernable. For example, in one embodiment, a game disc may be treated with a transparent chemical that, when exposed to oxygen, becomes opaque. For example, a game disc may be treated with a chemical composition and then sealed immediately in an airtight package. As long as the game disc is sealed within the package, nothing is changed. However, once the player removes the game disc from the packaging and exposes it to oxygen, the game disc may only be readable only for a finite period of time before the chemical composition causes a change that results in the formation of an opaque substance that may inhibit or nullify the ability of an optical reader device to read the game disc. Such a change may additionally be accompanied by a change in color of a readable side of the disc (e.g., from red to black), adding a measure of visible and viewable evidence (i.e. from outside the package) that the game disc packaging has been tampered with and/or opened. Consequently, it may be difficult or impossible for an opportunist to acquire a plurality of game discs and then to view them before purchase, in an attempt to determine which ones are "winners" before paying for them, because one or more of the game discs will become unreadable and/or because one or more of the game discs will change color. Flexplay®, a product marketed by The Convex Group, Inc., of Atlanta, Ga., is an example of such technology. Examples of such methods are described in U.S. Application No. 2005/0037181 to Lawandy and U.S. Application No. 2005/0058800 to Lawandy et al.; the entirety of both publications are incorporated by reference herein for all purposes.

In another embodiment, a disc may be treated with an opaque chemical at the time the disc is produced and packaged. A reactive or catalytic chemical, such as a dissolvent solution, may then be made available at a location at which game discs are activated and sold. Thus, a player wishing to purchase such a game disc may bring the disc (e.g., enclosed in packaging) to a representative such as a casino cashier, who may then remove the packaging and apply the reactive chemical to remove the opaque chemical, thus making the game disc readable. It is contemplated that an automatic rinsing device containing the reactive or catalytic chemical would be available for use to remove the opaque chemical, which functions to minimize any exposure and/or skin contact with the reactive chemical. In this manner, game discs may be available on a casino slot floor, for example, to players who may impulsively desire to purchase them, though they may be unreadable unless such players additionally acquire or otherwise utilize the reactive or catalytic chemical, which may be much more closely monitored (e.g., stored in a secure location or only available within an automatic rinsing device).

Alternately or additionally, a variety of methods are contemplated for determining whether or not a player has performed any action that may constitute an attempt to fraudulently handle or view a game disc, wherein the attempt may comprise opening a jewel case or DVD case or other packaging associated with the game disc.

For example, one or more tamper-evident seals, labels or stickers may be utilized in conjunction with such packaging. In a more specific example, a tamper-evident seal, label, or sticker may be applied to a jewel case in a manner such that the seal, label or sticker must be removed, cut or otherwise altered to open the jewel case and gain access to a game disc such as a DVD stored therein. For example, FIGS. 9A, 9B, 10A and 10B illustrate two different size cases (e.g., FIGS. 9A and 9B depict a common CD jewel case, and FIGS. 10A and 10B illustrate a typical DVD case that is larger than the jewel case). In either configuration, a seal, label or sticker may be attached such that at least one portion adheres to a face of the case (such as face 905 or 1005) and another portion adheres to a tray, holder and/or backside case portion (such as backside 915 or 1015). In this manner, the case may not be opened (e.g., the face is separated from the backside by action of the hinge) without removing, cutting or otherwise altering the seal, label or sticker. However, as described, removing or altering the seal, label or sticker may result in a tamper indication (e.g., if the sticker is peeled off and/or exposed to heat, moisture and/or cold, characters and/or a residue remain on the packaging or appear on the sticker, and the like). In this manner, it may be difficult or impossible to open packaging associated with a game disc without triggering a tamper indication, thereby inhibiting the ability of an opportunist to purchase game discs which have been previously opened and/or viewed (as tampering would be evident to a representative, such as a casino cashier, who would then refuse to sell and/or refuse to activate the game disc).

In some embodiments, the game disc and/or the packaging may include a device configured to detect tampering that may incorporate, for example, a radio frequency identification (RFID) transponder. Various RFID transponder devices, or RFID tags, ranging in size, power, and other characteristics, may be utilized. When the RFID transponder is active, a receiver device may receive data from a memory of the transponder when it enters a radio frequency field emitted by the receiver device. RFID tags are currently used in some retail stores, for example, to safeguard against shoplifting of merchandise such as clothing, and research and development of smaller, lightweight and low cost RFID tags is ongoing. In some embodiments, the RFID receiver device may be positioned at a location within a casino where game discs are activated and sold. Accordingly, when a player desires to purchase a game disc, he may bring the disc (enclosed in packaging) to the location, at which point the RFID tag or transponder may transmit data to the RFID receiver, so long as the transponder is functional and/or active. A receiver may receive various types of data from a functional, active transponder. For example, a memory of a transponder device may store a unique identifier. Alternately or additionally, a memory of a transponder may simply store data indicating that the transponder device is active and/or functional (e.g., has not been rendered non-functional, ineffective and/or broken). Accordingly, a game disc and/or associated packaging may be brought to a point of sale device where it is determined whether or not a transponder device associated with the packaging is active and/or functional. If the transponder device associated with the packaging is active and/or functional, the associated game disc may then be sold and/or activated.

Thus, in the embodiment described above, should a transponder device become ineffective and/or non-functional, an associated game disc may not be sold and/or activated. Various methods of rendering such a transponder device ineffective and/or non-functional are contemplated wherein the rendering of such a transponder device as ineffective and/or non-functional coincides with an attempt by a player to view a game disc or open associated packaging without first purchasing the game disc. Several methods are contemplated for accomplishing such an operation. In one example, the transponder device may be incorporated into or affixed onto the packaging in such manner that opening the packaging (e.g., opening the jewel case) may break or otherwise disable a metal coil or other substance (e.g., carbon conductive ink) that is functioning as antennae for the transponder (e.g., once the jewel case is opened, the RFID transponder is no longer able to effectively transmit a signal to a receiver). When a player brings this game disc to a POS, the receiver will not be able to pick up a signal and the cashier will then refuse to sell and/or to activate the game disc. In another example, the transponder device may be rendered ineffective without necessarily physically breaking a component of the transponder device. For example, various devices may be positioned around the exits of a casino that may function to corrupt a memory of such a transponder device. For example, such devices may emit a magnetic field of a certain radius, and should a transponder device enter such a radius, the memory of such a transponder device may be deleted, corrupted or otherwise rendered non-usable. In this manner, if a player brings a game disc off-premises without first purchasing the disc, the transponder is ineffective or non-functional (e.g., a memory is no longer functional and/or no longer contains data necessary for purchase), such that an attempt to purchase that game disc at a later time will be denied. In another example, receiver devices may be positioned near all exits of a casino floor so that any attempt to remove a game disc from the casino floor without deactivating the RFID transponder results in an alarm going off. The alarm may be, for example, a visual and/or audio signal that would erupt and be apparent to casino personnel as well as patrons of the casino, or may be a silent alarm that alerts security personnel who may be located within or outside of the casino.

In one embodiment, one or more RFID receivers may be placed in various locations throughout a casino property to track the movement of game discs and/or to track the associated packaging. For example, a receiver may be placed in every trash bin, to track game discs that have been thrown away by casino patrons. Receivers may also be placed at other locations, such as casino property entrances and/or exits, points of sale, or points of game disc and/or packaging distribution. In some embodiments, such a system may determine a percentage of game discs (e.g., all manufactured discs, all purchased discs, all inactive discs, etc.) within (or not within) range of various receivers. For example, such a system may determine that more than 5% of all game discs are currently not within range of any receiver on a casino floor. Such data may be useful to determine the behavior of purchasers or potential purchasers of such discs such that certain areas of the casino property may be "stocked" with lesser or greater amounts of (e.g., inactive) game discs. For example, if more than 20% of game discs stocked in a particular gaming room end up being tossed aside or thrown into trash bins instead of being purchased and activated, that gaming room might be stocked with a lesser amount of game discs in the future.

In some embodiments, a player purchases a game disc and receives one or more game cards that contain information used to determine what payouts, if any, are associated with that game disc. In addition, an RFID tag may be associated with such game discs or with their packaging and the RFID tag may be activated, deactivated or otherwise updated at the time of purchase. An RFID tag may function to store and transmit small amounts of information for short distances. For example, an RFID tag associated with a game disc may keep track of when and where the game disc was placed on display and/or dispensed, and how many and/or which types of game cards were purchased with any particular game disc. Such information may be useful to track game discs. For example, such information may be used to determine that game discs dispensed from multiplayer gaming machines have an average of 3.2 gaming cards associated with them, whereas game discs placed in casino hotel rooms have a 45% chance of leaving the hotel without having a single game card being purchased.

In some embodiments, locations that stock game discs for sale (such as hotel front desks and casino retail outlets) may provide an optional RFID deactivation service for players who are concerned about their privacy. Some or all of the methods described above could be used to render the RFID tag non-functional and/or ineffective. Marketing materials associated with the game discs may contain information about the RFID system and the types of data collected, serving to inform players about privacy issues.

In some embodiments, an RFID-tagged game disc may function to trigger a device and/or to alert casino personnel to remind a player who has picked up the game disc that the disc must be activated before it can be used. For example, an RFID receiver could be located in a doorway or other threshold of a casino and function to transmit a prompt signal to alert a person, such as a casino representative, that a player walking out of the gaming floor area is holding a game disc that has not been activated. Such a prompt signal may be transmitted, for example, to a CPD 325 that is in the possession of a casino representative. The casino representative can then approach the player and offer to activate the game disc by selling him one or more game cards. (In such a case, care must be taken by the casino employee to frame the offer in a manner to avoid antagonizing or alienating the player, or to avoid making the player feel as if she is being monitored or tracked).

In other embodiments, the game disc or the packaging may incorporate a Global Positioning System (GPS) device (e.g., a small semiconductor chip affixed to or embedded within the game disc and/or the packaging). Such a GPS device may comprise a memory for storing geographic locations as the game disc and/or the game disc packaging is moved about, as is known in the art. For example, when a player picks up a game disc from a display of discs on a casino floor, the GPS device may be configured to activate and to store game disc position location information at preset time intervals in its memory so that casino personnel, for example, can determine whether or not the GPS device has left casino grounds (e.g., at all, since it first arrived, etc.), and if so, the purchase and/or activation of the disc may be denied. In some embodiments, it may be possible to wirelessly communicate with the GPS device to obtain location information of particular game discs.

Other tamper evident and/or security items are contemplated that may be associated with the game disc and/or with the packaging. For example, a security strip may be added to each game disc, wherein the security strip may be made of a polymer or metal material and may be embedded into the disc or otherwise affixed to or embedded within the packaging. Such a security strip may contain microprinting or other anti-counterfeiting technology and may also be positioned so as to be visible and/or easily recognizable by casino personnel and/or readable by an automatic security device. In some embodiments, the security strip or other security item may have one or more unique characteristics (such as emitting a weak magnetic field) that must be neutralized or deactivated before the game disc can be activated and/or sold and/or removed from the premises. Failure to deactivate such a security item would cause an alarm device to activate, for example, if an attempt was made to remove the game disc from the premises.

In other embodiments, other devices may be utilized that include, but are not limited to, electronic alarm circuitry and wireless communications circuitry. The alarm circuitry may include audio and/or visual electronic components such as speakers and LED's that may be triggered to go off to provide a tamper indication, for example, if the package is opened before the alarm circuitry has been deactivated. In an embodiment, only casino personnel have the required means (such as a security deactivation device and/or a special code) to deactivate the alarm circuitry components at the time of purchase and game disc activation. The communications circuitry may be operable, for example, to transmit an alarm signal to a wireless receiver carried by security personnel if an opportunist is attempting to open a game disc before purchasing and/or activating that game disc.

Thus, as described, some embodiments contemplate a process wherein a casino agent (i) receives a game disc and/or associated packaging from a player wishing to purchase the disc, (ii) determines whether or not the player has attempted to open the packaging and/or view the game disc as described, and if the player has attempted to open the packaging and/or view the game disc, then (iii) refuses to activate and/or sell the game disc. Further, in some embodiments, the process may include additional steps such as using a computing device in communication with one or more databases described herein to update one or more status indicators associated with the player and/or associated with the game disc (or with the associated gaming session or game contract or game session or game credit balance). For example, a record or records contained in a player database associated with the player may be flagged to indicate that the player has attempted to fraudulently purchase a game disc, the appropriate authorities may be notified of the attempted fraud (e.g., governmental, regulatory, executive, etc.), and other database entries as appropriate may be modified, for example, to indicate that the particular game disc in question is no longer available for sale and/or activation. In addition, the casino agent may be required to activate game discs in a predetermined location, such as in an area that includes a fixed position barcode scanner so that the transaction may be monitored, for example, by security cameras. Such a policy may discourage casino agents from attempting to keep game discs and/or wagering game receipts that they believe or perceive contain winning payouts for themselves instead of selling them to players.

It should be noted that any or all of the aforementioned security devices and processes described above may be used in any combination which may depend on one or more various considerations, such as cost, regulatory requirements, and packaging configuration. Thus, a game disc may include multiple tamper evident devices that may be associated with only the game disc, only the packaging, or with both. Moreover, any or all of the aforementioned security devices and processes described above in association with game discs may also be utilized in conjunction with various other products or media. For example, such security devices and processes may be used in conjunction with DVDs, CDs or CD-ROMs comprising other content, or may be used in conjunction with any retail product where it may be desirable to detect whether the product has been opened or altered.

Further, some embodiments of the present invention may be applied outside the field of casino gaming. For example, in pharmaceutical drug manufacturing and distribution there is a need for product packaging that is tamper evident. A consumer filling a prescription for blood pressure medication, for example, needs to be confident that the pills within the container have not been tampered with while in transit to the pharmacy or to her home. Some of the above RFID tag embodiments mentioned above could prove to be an effective solution to such a problem. For example, a pill bottle cap could be outfitted with an RFID tag, which is destroyed when the cap was removed or twisted. RFID readers at the pharmacy could be configured to quickly identify a product container that has been tampered with (or perhaps simply damaged in the distribution process or while in transit) by determining whether or not there is an RFID signal. In GPS embodiments, the pharmacy may be equipped with a device capable of obtaining GPS data from the pill bottle cap to confirm that the pill bottle had taken a prescribed route to the pharmacy. Such an embodiment might reveal not only any tampering attempts (for example, by indicating that the pill bottle had been detoured to another state) but could also reveal whether the pill bottle had come from an approved location (e.g. the pill bottle originated at a reputable pharmaceutical company and had not been illegally re-imported from another country, for example).

Figure 11:
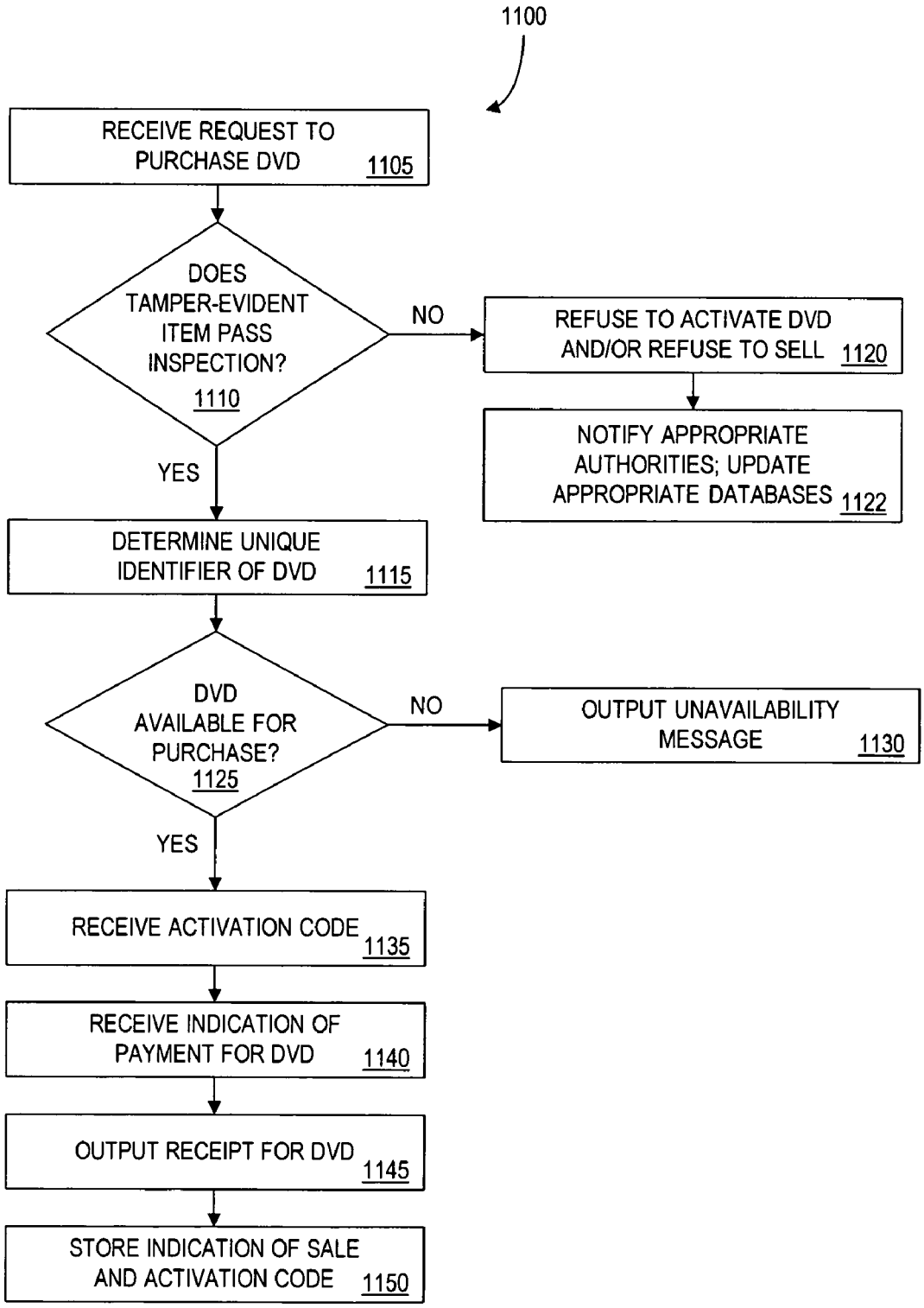
FIG. 11 is a flowchart of an example process for storing an indication of a sale of a DVD, in accordance with some embodiments described herein.

FIG. 11 illustrates a process 1100 for facilitating the purchase of a DVD or other tangible medium that contains a plurality of outcomes of a wagering game, and has associated therewith at least one tamper evident item. The process 1100 may be performed, for example, by a casino cashier or other casino representative who may be stationed at a POS 320. As mentioned above, the POS 320 may be in a fixed position that requires a casino agent or cashier to inspect and to activate the DVD containing the wagering games in an area that includes surveillance devices operable to discourage interference with the sale of the DVD, or tampering with the DVD by the casino agent or cashier.

In step 1105, a request to purchase a DVD is received. For example, in one embodiment, a player may select a DVD from a display on a casino slot floor that has recorded thereon a video presentation of slot machine game outcomes based on the outcomes previously generated by a GD. Alternatively, the player may request that the casino attendant provide a DVD selected from behind a casino counter for purchase. Step 1105 may comprise, for example, receiving input from a casino attendant at the POS 320 that indicates that a new transaction for the purchase of such a DVD is to be initiated. In another embodiment, step 1105 may comprise receiving a request from a player to purchase a DVD containing certain parameters, such as a particular type of game, a wager amount per game play, a number of game plays, and a price.

In step 1110, the casino attendant inspects the DVD and/or the jewel case, for example, to determine if the tamper evident item(s) (i.e. a security seal) is/are intact. If the tamper evident item(s) pass inspection, then in step 1115, a unique identifier of the DVD is determined. However, if the tamper evident item does not pass inspection (i.e. tampering appears to have occurred), then in step 1120 the casino attendant refuses to activate the DVD and/or refuses to sell the DVD. The process may also include step 1122, wherein the appropriate authorities are notified and one or more appropriate databases are updated as described above.

When the tamper evident item associated with the game disc passes inspection, a unique game disc identifier on the packaging of a DVD (or, in some embodiments, on the DVD itself may be entered via a bar code scanner or keyboard, for example. In embodiments in which the request for the DVD comprises a request that a DVD be generated on behalf of a player, step 1115 may comprise determining or assigning a unique identifier for the DVD to be created. For example, a unique DVD identifier may be generated based on a program or algorithm or a previously generated but as yet unassigned DVD identifier may be retrieved from a database of available DVD identifiers. In one embodiment, step 1115 may comprise determining a session identifier of a session associated with the DVD previously created or the DVD to be created.

In step 1125, it is determined whether the DVD is available for purchase. For example, a database may be accessed and it may be determined whether the status of the DVD is set to "available" or other information associated with the DVD may be retrieved, based on the unique identifier received in step 1125, that allows a determination of whether the DVD is available for purchase. In one embodiment, POS 320 accesses such information and determines the availability of the DVD for purchase. In other embodiments, POS 320 transmits an indication of the unique identifier to another device (e.g., CS 305), which determines the availability of the DVD for purchase and transmits an indication of the availability to POS 320. In embodiments in which the request to purchase a DVD is a request for a DVD to be created, step 1125 may comprise determining whether a session as defined in the request of step 1105 may be created (e.g., whether the requested combination of parameters and values thereof are approved or approvable).

If the DVD is not available for purchase, a message indicating the unavailability of the DVD for purchase is output in step 1130. For example, such a message may be output to a casino attendant (who may communicate the message to the player requesting to purchase the DVD) and/or directly to the player requesting to purchase the DVD. Otherwise, the process 1100 continues to step 1135.

In step 1135, an activation code is received. The activation code may comprise, for example, a code provided to a player upon a legitimate purchase of a DVD, to be used by the player as subsequent proof of the purchase and/or to activate a video presentation recorded on the DVD. In some embodiments, the activation code may simply comprise a unique transaction identifier generated or otherwise determined by POS 320. In other embodiments, an activation code may be distinct from a transaction identifier. In some embodiments, a unique activation code may be generated at the time of a purchase of a DVD (e.g., using an algorithm created for this purpose). In other embodiments, an activation code may be selected from a list of previously generated and available activation codes. In some embodiments, an activation code may be encrypted. In some embodiments, the activation code associated with the DVD may be assigned at the time of purchase of the DVD or may be pre-assigned, and may be stored in a record of a database associated with the DVD (e.g., in association with the disc identifier and/or other unique identifier already associated with the DVD). It should be noted that, in some embodiments, an activation code may be determined and associated with a particular DVD during the manufacturing process.

In step 1140, an indication of payment for the DVD is received. For example, an operator of POS 320 may indicate an amount and form of payment received for the DVD, as is known in the art of POS operations. In some embodiments, step 1140 may comprise first retrieving the price of the DVD (e.g., from a database, or by scanning or otherwise determining a price indicated on the DVD or packaging thereof).

Figure 14:
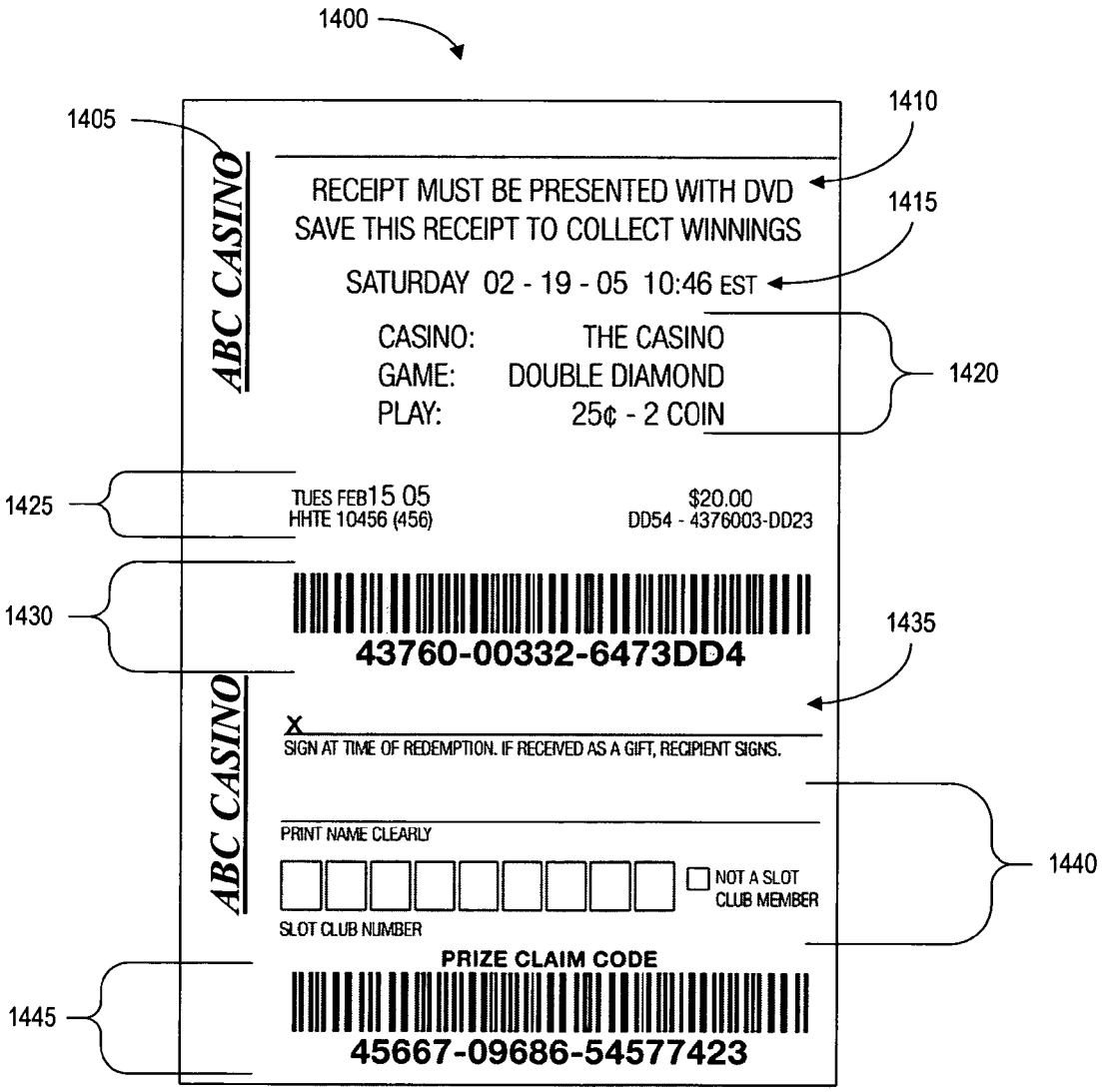
FIG. 14 is an example of a wagering game receipt that may be provided upon a purchase of a DVD, in accordance with some embodiments described herein.

In step 1145, a wagering game receipt for the DVD is output. An example of such a receipt is illustrated in FIG. 14

(described in detail below). For example, POS 320 may cause a receipt to be printed. In some embodiments, the receipt for the DVD may be e-mailed to the player or provided to the player in another electronic form. In some embodiments, the activation code may be included on the receipt. The casino or other entity responsible for selling the DVD to the player may retain a copy of the receipt.

In step 1150, an indication of the sale of the DVD is stored, along with the activation code. For example, a database may be accessed and the current date and time may be stored in the date sold field. The activation code now associated with the DVD may also be stored in the record of such a database. The status of the DVD may be set to "purchased" or another similar status.

In some embodiments, various steps may be taken to prevent or discourage fraudulent purchase of pre-packaged DVDs, by casino attendants, for example. Deterrents may be necessary because in some embodiments game play results have already been generated at the time of purchase, so the casino may wish to disguise the redemption values of such DVDs (e.g., such that players and casino employees may not figure out a way to "beat the system" by purchasing DVDs which they may know or suspect include large redemption values). For example, when generating a wagering game receipt or a cashout ticket or otherwise outputting session result data associated with a session on which a resultant DVD will be based, no final session balance may be indicated or may only be indicated in an encrypted form (e.g., such that a casino attendant or other person with an opportunity to view the wagering game receipt or cashout ticket or other session result data may not be privy to whether the session has resulted in a relatively large aggregate balance or amount).

Additional measures may be taken to prevent casino employees or other persons in a position of becoming aware of or otherwise gaining access to session result data associated with a session (whether it be a session for a pre-packaged DVD or a session executed on behalf of a particular player). For example, in one embodiment, no session result ticket may be output. In another embodiment, a casino attendant administering a session or otherwise having an opportunity to gain access to session result data may not be allowed to view game play results using a display screen of a GD or otherwise. In some embodiments, as discussed above, the casino employee may be required to sell the DVD to a player by handling the transaction in a designated area that is covered by casino surveillance equipment (that the casino employee may know is there) to discourage him from trying to "beat the system" by placing certain DVDs aside for himself (that he recognizes as potential winners) and selling another to the player.

In some embodiments, a third party may administer the creation of video presentations. For example, a casino attendant may execute a session using a GD, such that afterwards a cashout ticket (that does not indicate a final session balance, but is printed nonetheless for auditing purposes) and a game video ticket are output. The casino attendant may then provide the game video ticket to the third party. The third party (e.g., AS 500 or operator thereof) may then scan a barcode of the game video ticket and produce a pre-packaged DVD based on the information encoded on the game video ticket. In this manner the final session balance associated with the DVD may not be known by a casino at the time it is provided to a player. In some embodiments, at the time a DVD is given to the casino by the third party, a payout code may additionally be provided. For example, in some embodiments, players having purchased sessions or DVDs created based thereon may fail to claim winnings (e.g., redeem the DVD for the redemption value) that they are due. Accordingly, in some embodiments, a casino may be responsible for providing such payouts to players, though to prevent fraud, casinos may not learn of a final session balance associated with a session until after an associated video presentation has been provided to a player. For example, thirty days after a DVD has been sold to a player, a casino may provide the payout code to the third-party, who then may inform the casino of a final session balance due to the player.

Figure 12:
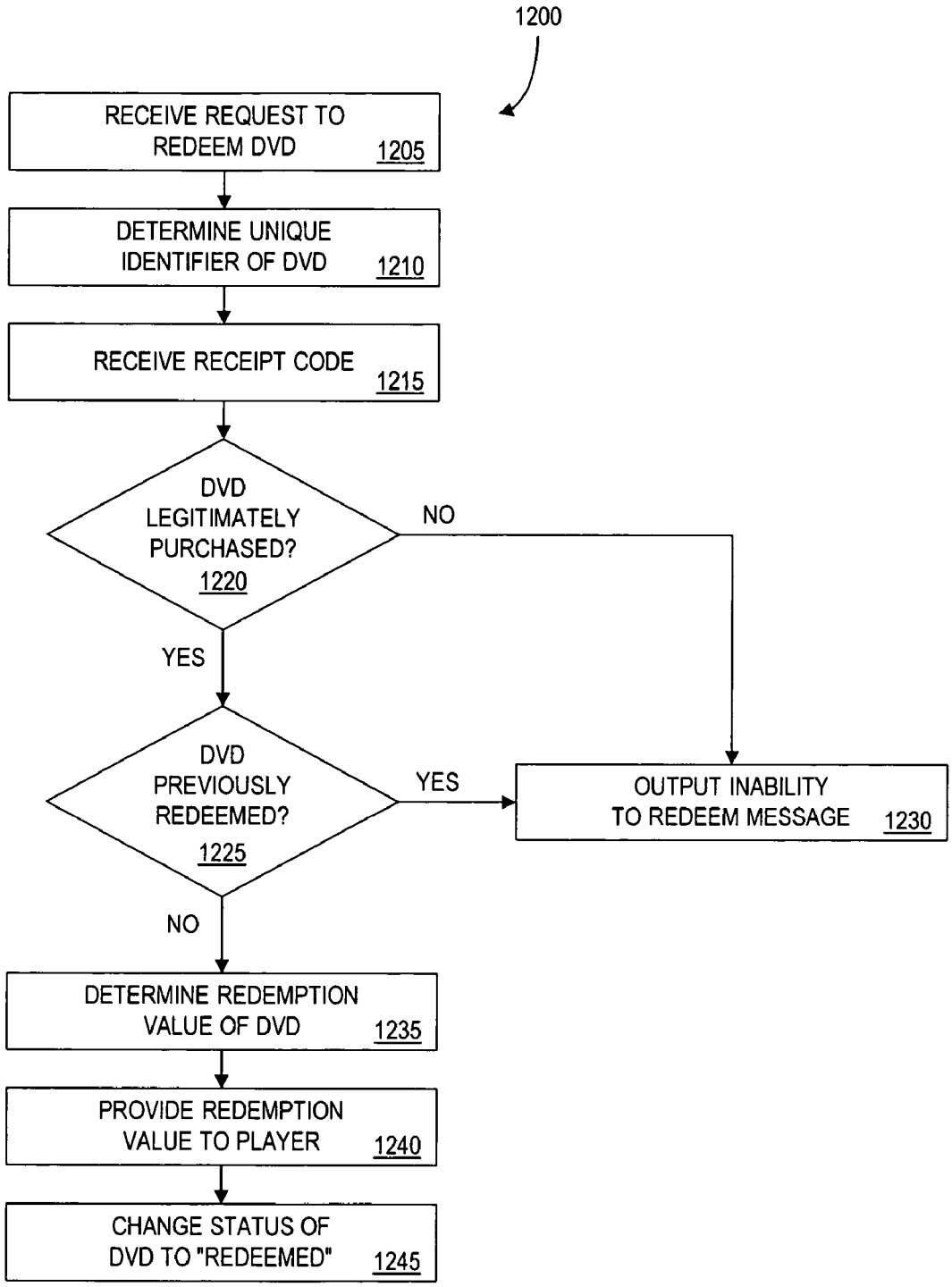
FIG. 12 is a flowchart of an example process for providing a payment corresponding to a DVD redemption value, in accordance with some embodiments described herein.

FIG. 12 is a simplified flowchart of an example process 1200 for redeeming a DVD. The process 1200 may be performed, for example, at a POS 320.

In one embodiment, a player who purchases a DVD may return to the casino at which the DVD was purchased. By presenting any or all of a (i) a disc identifier, (ii) activation code, (iii) wagering game receipt and/or (iv) valid photo identification, the player may be able to redeem the DVD for the redemption value of the DVD (which may be the end credit meter balance of the session on which the DVD video presentation was based, or which may be a credit meter balance located at a predetermined position within the session). The player may, for example, collect a redemption value that corresponds to the $231^{st}$ spin of a 500 spin session of outcomes on the DVD she purchased from one or more of (i) a casino attendant operating a computer device (e.g., POS 320 or CPD 325), (ii) a kiosk operable to facilitate the redemption of DVDs (e.g., by receiving a session identifier and/or other relevant information via an input device, accessing a database, and determining a final session balance or redemption value associated with the DVD) (iii) a GD, and (iv) another device. A redemption value may be provided to a player, for example, in the form of cash, voucher, gaming credit, or any other form. In some embodiments, players may be given an incentive to return to a casino to redeem DVDs (e.g., casinos may recognize that drawing customers back to their property may lead to increased gambling activity and thus increased revenues). For example, if a player is due a final session balance of $63.25, the player may be offered an amount more than the final session balance (e.g., an additional $10) to redeem the DVD at the casino (e.g., rather than having a check for the redemption value of the DVD mailed to the player).

In one embodiment, a player may redeem a DVD without returning to the casino at which the DVD was purchased. For example, a player may contact a casino after viewing a video presentation (e.g., via postal mail, phone, fax, e-mail, a form of a casino Web page, etc.) and indicate a session identifier, disc identifier, activation code and/or some other information (e.g., a home phone number) by which a casino may determine a redemption value due to the player. In one embodiment, the player may be given an opportunity to specify whether the player prefers to be mailed a check, to have funds transferred in some electronic manner (e.g., funds are transferred electronically to a players financial account) or to have the redemption value provided to the player in some other manner.

In some embodiments, a player may not contact a casino after purchasing a session. In one such embodiment, if a player is owed a final session balance based on the purchased session, the casino may wait a predetermined period of time after the purchase of the DVD associated with the session. If this period of time (e.g., 30 days) elapses without any contact from the player (e.g., the player does not return to the casino to redeem the DVD), the casino may automatically issue any funds owed to the player (e.g., by mailing a check to a provided address or storing the funds in a financial account associated with the player).

In some embodiments, although a redemption value greater than zero may correspond to a session purchased or provided to a player and a price may be associated with the session, the player may have not yet paid the price at the time he requests the redemption value. Accordingly, in some embodiments, the price of the session may be deducted from the redemption value. If the redemption value is greater than the price, the player may be paid the difference. If however, the redemption value is less than the price, the player may be paid nothing.

In some embodiments, a session may end with a negative balance (e.g., at the end of the session, the sum of wagers deducted from a starting credit meter balance exceeds a sum of payouts added to the starting credit meter balance). In some embodiments, such negative balances may be treated similarly to a balance of zero credits; in other words, the redemption value of the session may be zero. Similarly, if the redemption value of a particular game disc is associated with an intermediate outcome within a session, for example, the $115^{th}$ outcome of a 500 outcome session, and if the credit meter at that point (the $115^{th}$ outcome) is negative, then the redemption value would be zero.

It should be noted that, in various embodiments, a player may have an opportunity to redeem a DVD without having watched the video presentation recorded on the DVD in its entirety (or at all). For example, a player may purchase a DVD containing a video presentation, but may not have a chance to watch the video presentation before his next trip to the casino. In some embodiments, such a player may be allowed to redeem the DVD irrespective of the failure to watch the video presentation. However, in other embodiments, a player may not be allowed to redeem a DVD unless the player provides a special code, wherein such special code is only output upon (e.g., during) the conclusion of a video presentation recorded on the DVD (e.g., an alphanumeric code or password is displayed during or after a final game play result is depicted). In some embodiments, such a special code may occur at some intermediate point in the session before the final game play result.

Referring again to FIG. 12, in step 1205 a request to redeem a DVD is received. For example, a player may approach POS 320 and provide the DVD to be redeemed (and/or packaging and/or wagering game receipt or other documentation thereof) and request the redemption value of the DVD to be provided to the player. In another example, a player may contact a casino or other entity that facilitates the redemption of purchased DVDs in another manner (e.g., via telephone, e-mail, the Internet, postal mail, etc.) to request the redemption of a DVD.

In step 1210, a unique identifier of the DVD is determined (e.g., based on information provided in the request to redeem the DVD). For example, a disc identifier located on packaging of the DVD may be scanned in or typed in by a casino attendant (in such embodiments a player may be required to provide the DVD, or at least the packaging thereof, when redeeming the DVD).

In step 1215, a receipt code is received. For example, an activation code printed on the receipt may be received. In another example, a unique receipt identifier uniquely identifying the receipt and/or transaction in which the receipt was issued is received. For example, a casino attendant may scan or type in the code. That is, in some embodiments a player may be required to provide a receipt (or copy thereof) for the purchase of a DVD when requesting to redeem the DVD. In some embodiments in which the code received in step 1215 is an activation code, the activation code for a DVD may have been provided to a player in a manner other than being printed on a receipt (e.g., it may have been provided to a player via e-mail, via another printed document, verbally, etc.). Accordingly, in some embodiments in which an activation code is required to redeem a DVD, step 1215 may comprise receiving the activation code in any manner desired and practicable and not necessarily via a receipt (in which case a receipt may or may not be required to redeem the DVD).

In step 1220, it is determined whether the DVD has been legitimately purchased. For example, a database or other memory structure storing information about DVDs previously purchased may be accessed. For example, a database may be accessed and it may be verified that the disc identifier and activation code correspond to one another in the database and, further, that the status of the DVD corresponding to the disc identifier is currently "purchased." In one embodiment, POS 320 or another device performing the redemption process (e.g., a kiosk of a casino) may communicate with a device storing such information (e.g., CS 305). In one embodiment, the POS 320 or other device performing the redemption process may be operable to determine whether the DVD was legitimately purchased by accessing such a database and verifying the information received. In another embodiment, the POS 320 or other device performing the redemption process may forward the information received to another device (e.g., CS 305) storing information useful in verifying the legitimate purchase of the DVD and determine that the DVD was legitimately purchased upon receiving an authorization message or indication from this other device.

If it is determined that the DVD was not legitimately purchased, a message indicating an inability to redeem the DVD is output in step 1230. For example, a message indicating that the system is "unable to confirm previous purchase" may be output to a display (e.g., to a payer attempting to redeem the DVD and/or to a casino attendant facilitating the redemption process, who in turn may communicate this information to the player) and the redemption of the DVD may be denied. Otherwise, the process 1220 continues to step 1225.

In step 1225, it is determined whether the DVD has previously been redeemed. This step may be performed to prevent "double dipping" or an attempt by a player to redeem a DVD more than once. This step may also be performed to prevent double payment on a DVD that may have already been redeemed by, for example, another family member without the knowledge of the player. For example, an appropriate database may be accessed to determine whether the status of the subject DVD is set to "redeemed" or to another status indicating that the DVD has previously been redeemed (or if a previous successful redemption of the DVD is otherwise stored in a memory). In one embodiment, POS 320 or another device performing the redemption process (e.g., a kiosk of a casino) may communicate with a device storing such information (e.g., CS 305). In one embodiment, the POS 320 or other device performing the redemption process may be operable to determine whether the DVD was previously redeemed by accessing an appropriate database and confirming whether information stored in the database indicates that the DVD has previously been redeemed. In another embodiment, the POS 320 or other device being used to perform the redemption process may forward the information to another device (e.g., CS 305) that is storing information useful in determining whether a DVD has previously been redeemed, and then determine that the DVD has not previously been redeemed upon receiving an authorization message or indication from this other device. In some embodiments, the determinations of steps 1220 and 1225 may be performed in a single step and/or by a single device.

If it is determined that the DVD has already been redeemed, a message indicating an inability to redeem the DVD is output in step 1230. For example, a message indicating "previously redeemed" or another appropriate indication may be output (e.g., to a player attempting to redeem the DVD and/or to a casino attendant facilitating the redemption process, who in turn may communicate this information to the player) and the redemption may be denied. Otherwise, the process 1225 continues to step 1235. Such a process enables any one of multiple forms of identification to be used to redeem a DVD, without a casino or other responsible party having to be concerned about erroneously providing multiple payouts for the same DVD.

In step 1235, the redemption value of the DVD is determined. For example, a record of a database associated with the DVD may be accessed and the redemption value may be read from the database. In some embodiments, the redemption value may be encoded on the DVD itself and/or on the packaging thereof, and/or on the wagering game receipt, and may be read therefrom (e.g., in addition to or in lieu of accessing a database storing such information).

In step 1240, the redemption value is provided to a player, and in step 1245 the status of the DVD is changed to "redeemed". As described, a status field 535 of an available DVDs database 500 may be updated to reflect that the DVD has been redeemed, and the redemption value may be provided to a player in many different forms and in a variety of different manners. For example, cash may be handed to the player by a casino attendant or dispensed from a kiosk. In another example, a cashless gaming receipt that may be redeemed at a casino booth or that may be used for wagering at a GD may be provided, the value of the receipt being based on the redemption value. In yet another example, a check may be mailed to a player. In another example, an electronic and/or financial account associated with the player may be credited based on the redemption value. In some embodiments, a redemption value may correspond to a physical prize to be provided to the player (e.g., a coupon, piece of jewelry, discount booklet, gift certificate or other tangible item). In such embodiments, step 1240 may comprise authorizing a casino attendant to provide the prize to the player. Step 1240 may further comprise storing an indication of the successful redemption of the DVD in a memory (e.g., a status field of a database may be set to "redeemed"), to prevent redeeming of that DVD a second time. Alternatively, such a step of storing an indication of the successful redemption of a DVD may be a distinct step of process 1200.

Figure 13A:
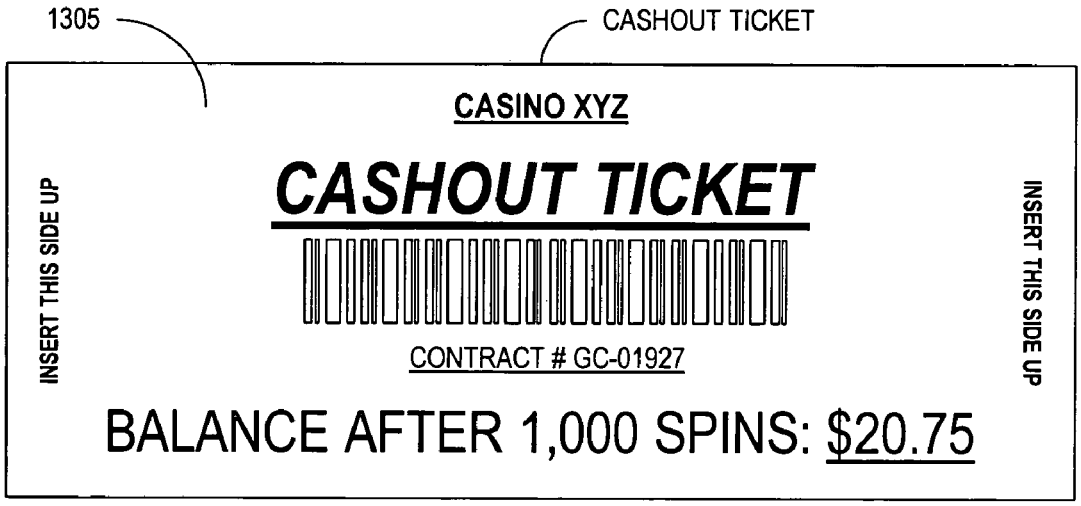
Figure 13B:
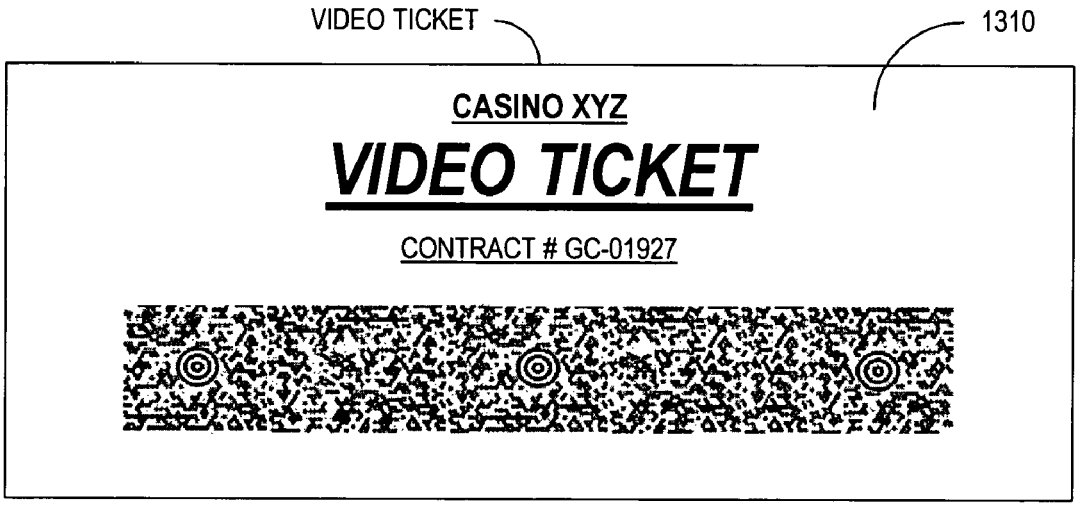

FIGS. 13A-13C illustrate three distinct examples 1300, 1310 and 1315, of tickets that may be printed by a GD, each ticket having an indication of a result of a session printed thereon. A ticket such as one of these three examples may be printed, for example, for auditing purposes, placed in a DVD jewel case for a player to use to redeem a payment associated with the DVD, and/or used to provide an indication to a device (e.g., AS 310) of one or more outcomes of a session, the latter for purposes of creating a video representation of the outcomes for recording onto a DVD. Such tickets are referred to as "session results tickets" herein, as they typically store an indication of one or more results (e.g., payouts, sum of payouts) of a session.

Of course, a session results ticket may store an indication of other information associated with a session as well, such as an indication of one or more parameters defining a session and/or values thereof. Examples of such other information may include, without limitation, (i) an end credit meter balance of the session; (ii) one or more intermediate credit meter balances corresponding to particular outcome values within the session that may be predefined; (iii) a price of the session; (iv) a beginning credit meter balance for the session; (v) a number of outcomes generated for the session; (vi) a player associated with the session; (vii) a casino attendant associated with the session; (viii) a time and/or date at which the session was initiated and/or completed; (ix) a gaming device at which the session was conducted; (x) a game for which the outcomes of the session were generated; (xi) a casino at which the ticket was generated and/or is redeemable; and (xii) a unique session identifier associated with the ticket.

In one embodiment of a session results ticket printed for a three-reel slot machine game, each outcome of a three-reel slot machine game, as well as a corresponding payout information, appears as text. Such a ticket is illustrated in FIG. 13C as the "RESULTS TICKET" 1320. Using conventional TITO tickets (measuring 2.5"×6"; or approximately 6.35 cm×15.24 cm) and TITO ticket printing technology, text regarding a substantial number of outcomes may be printed on a ticket in this manner. Several of such tickets may be used as necessary (e.g., a program stored within the memory of a GD instructs a printer device to print 20 tickets, each with 50 game results of a 1,000 spin session). Exemplary paper tickets suitable for use according to such embodiments are sold by Slot-Tickets.com™ of Memphis, Tenn. Of course, other methods of printing an indication of outcomes of a session are contemplated. For example, rather than print an indication of a limited number of outcomes on a small, conventional ticket, a GD may comprise a roll of receipt paper similar to those known and used in common retail systems, such that an indication of a substantially large number of outcomes may be printed on one contiguous piece of paper (e.g., which may be torn off by a casino attendant or other authorized person after printing is complete). Such printing may occur at any time during or after the execution of a session. A printed record of a result of a session may not only be desired by players (who may view the record at a later time), but also may be filed or stored by a casino or other entity for auditing purposes (e.g., regulations may require that such printed records exist).

In some embodiments, an authorized person (e.g., casino employee) may specify that a GD print a conventional "CASHOUT TICKET" 1300 which is shown in FIG. 13A. Such a cashout ticket 1300 indicates a balance of credits and/or currency at the conclusion of the execution of a session.

In one or more embodiments, an indication of a result of a session may be printed in an encoded or encrypted form, or a form that is readable by a device but not easily discernable by a person. For example, FIG. 13B illustrates a "VIDEO TICKET" 1310 that includes a high-density barcode that includes encoded data that may be associated with one or more outcomes or session results. Such encoded data may then be used to render a video presentation of outcomes, which may be viewed remotely by a player who has purchased a DVD on which outcomes representative of the result of the session are recorded. For example, text, numerals or other symbols or indicia stored within a session database (e.g., a series of outcome identifiers) may be encoded such that they are represented graphically by a barcode such as a high-density barcode.

In some embodiments, various parameters or settings of a GD and/or session may be set to "default" (e.g., a GD automatically prints a cashout ticket 1300, video ticket 1310 and game result ticket 1320 upon the conclusion of an executed session). In some embodiments, an authorized person (e.g., a casino employee executing the session or causing the GD to execute the session) may alter one or more of these parameters from the default sessions. In other embodiments, such an authorized person may not be authorized to alter certain settings.

In some embodiments, an entity (e.g., an operator of a AS 310) may determine session result data from a session results ticket. For example, if the session results ticket 1320 includes an indication of a session result encoded in barcode form, the session result may be determined by scanning a barcode of a session result ticket (e.g., such as the bar code of example session results ticket 1320). Such a barcode may encode, for example, a session identifier, a series of outcome identifiers and one or more associated GD identifiers.

In one embodiment, a device (e.g., AS 310) may comprise software to create a video representation of outcomes for recording onto a DVD based on session result data, such as may be determined from a session results ticket. For example, AS 310 may receive session result data associated with a session in a manner such that AS 310 need not communicate via an electronic network with a casino for purposes of obtaining such session result data, but may rather be operable to receive session result data via session result tickets. The AS 310 may be further operable to assemble video representations of outcomes based on such tickets and supply such video representations (e.g., in the form of DVDs on which such video representations are recorded) to players and/or casinos for subsequent sale to players.

FIG. 14 illustrates an example of a wagering game receipt 1400 that may be provided to a player upon a purchase of a DVD by the player. The receipt 1400 includes a name of a casino (in area 1405) that may indicate the casino at which the DVD was purchased, the casino at which the DVD may be redeemed, and/or the casino at which the session upon which the outcomes represented on the DVD were generated.

Area 1410 includes a printed message informing the player that the receipt 1400 must be presented in order for the corresponding DVD to be redeemed, as is consistent with some embodiments described herein. The receipt 1400 also includes (in area 1415) an indication of the date and time at which the DVD was purchased. Area 1420 of the receipt includes an indication of session information describing various parameters (and values thereof) defining the session upon which the DVD video presentation is based. For example, the example session information indicated on receipt 1400 is the name of the casino (e.g., casino at which the DVD was purchased, at which the DVD may be redeemed and/or at which the outcomes represented on the DVD were generated), the game for which the outcomes represented on the DVD were generated (Double Diamond), and an indication of the wager per game play (25 cents-2 coin) posted for each game play represented on the DVD. Of course, different and/or additional session information may be indicated on such a receipt.

The receipt 1400 also includes additional data (in area 1425) that may comprise encoded information and/or human readable information corresponding to the DVD and/or session (e.g., a redemption value, POS and/or casino attendant associated with the sale, session and/or DVD type, price of the DVD, etc.). A disc activation number in area 1430 may appear in both bar code and human readable form. The disc activation number may comprise, for example, a disc activation code as described herein.

The receipt 1400 also includes a signature line (in area 1435) that may comprise a line on which a player may be required to sign her name upon redeeming a DVD (e.g., as a measure preventing the player from claiming that the player has not redeemed the DVD and/or to discourage the player from attempting to re-use the receipt to again redeem the DVD). Another line and/or boxes may be included in area 1440 to be filled in by a casino attendant and/or a player upon a DVD being redeemed. For example, information relating to the authorization of the redemption, the date and/or time of the redemption, and/or the signature of the casino attendant facilitating the redemption may be filled in.

The receipt further includes a prize claim code (in area 1445). The prize claim code may comprise, for example, a barcode and/or a serial number that corresponds to a location to find pertinent information stored in a database. For example, the barcode may be scanned to obtain a prize claim code that may be a pointer to a record of a database that stores an indication of the redemption value of the DVD. In some embodiments, the prize claim code may comprise a disc identifier and/or a session identifier, as these are described herein.

In some embodiments, a first and second casino may be part of the same "session network." Accordingly, a player may enter a first casino and purchases a session and/or a DVD based on a session. The player may then enter a second casino and (i) collect a redemption value associated with the session and/or DVD; and/or (ii) alter one or more parameters associated with the session. Thus, in some embodiments, devices of a first casino and second casino may communicate with one another (e.g., so as to read from and/or write to one or more databases).

It cannot be over-emphasized that the use of a DVD as an example of a tangible media on which session result information may be recorded, to allow remote viewing of outcomes of the session, is intended as an example only and should not be taken in any limiting fashion. Thus, for example, although a sale of a DVD is described in detail with reference to FIG. 11, a similar process may be performed for a sale of a session in another remotely viewable form. For example, a sale of a CD-ROM, VHS tape, floppy disc, flash memory, memory stick, dedicated portable device for viewing video presentations, and paper-based flip-through book that illustrates the outcomes of a session may also be sold in a similar manner. In other words, the format or media via which the video presentation is provided to a player is not limited to a DVD. In another example, the redemption of a DVD as described is not intended to limit the redemption of a session result to be via a DVD form. For example, in one embodiment a player may provide a CD-ROM including a video presentation thereon and redeem the CD-ROM or associated wagering game receipt for the redemption value associated with the session. Any practicable method of outputting a video presentation to a player such that a player may purchase a plurality of outcomes and view them remotely at the player's convenience is contemplated.

Rules of Interpretation

Numerous embodiments have been described, and are presented for illustrative purposes only. The described embodiments are not intended to be limiting in any sense. The invention is widely applicable to numerous embodiments, as is readily apparent from the disclosure herein. These embodiments are described in sufficient detail to enable those skilled in the art to practice the invention, and it is to be understood that other embodiments may be utilized and that structural, logical, software, electrical and other changes may be made without departing from the scope of the present invention. Accordingly, those skilled in the art will recognize that the present invention may be practiced with various modifications and alterations. Although particular features of the present invention may be described with reference to one or more particular embodiments or figures that form a part of the present disclosure, and in which are shown, by way of illustration, specific embodiments of the invention, it should be understood that such features are not limited to usage in the one or more particular embodiments or figures with reference to which they are described. The present disclosure is thus neither a literal description of all embodiments of the invention nor a listing of features of the invention that must be present in all embodiments.

The terms "an embodiment", "embodiment", "embodiments", "the embodiment", "the embodiments", "an embodiment", "some embodiments", "an example embodiment", "at least one embodiment", "one or more embodiments" and "one embodiment" mean "one or more (but not necessarily all) embodiments of the present invention(s)" unless expressly specified otherwise. The terms "including", "comprising" and variations thereof mean "including but not limited to", unless expressly specified otherwise.

The term "consisting of" and variations thereof mean "including and limited to", unless expressly specified otherwise.

The enumerated listing of items does not imply that any or all of the items are mutually exclusive. The enumerated listing of items does not imply that any or all of the items are collectively exhaustive of anything, unless expressly specified otherwise. The enumerated listing of items does not imply that the items are ordered in any manner according to the order in which they are enumerated.

The term "comprising at least one of" followed by a listing of items does not imply that a component or subcomponent from each item in the list is required. Rather, it means that one or more of the items listed may comprise the item specified. For example, if it is said "wherein A comprises at least one of: a, b and c" it is meant that (i) A may comprise a, (ii) A may comprise b, (iii) A may comprise c, (iv) A may comprise a and b, (v) A may comprise a and c, (vi) A may comprise b and c, or (vii) A may comprise a, b and c.

The terms "a", "an" and "the" mean "one or more", unless expressly specified otherwise.

The term "based on" means "based at least on", unless expressly specified otherwise.

The methods described herein (regardless of whether they are referred to as methods, processes, algorithms, calculations, and the like) inherently include one or more steps. Therefore, all references to a "step" or "steps" of such a method have antecedent basis in the mere recitation of the term 'method' or a like term. Accordingly, any reference in a claim to a 'step' or 'steps' of a method is deemed to have sufficient antecedent basis.

Headings of sections provided in this document and the title are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required, or that each of the disclosed components must communicate with every other component. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described in this document does not, in and of itself, indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately programmed general purpose computers and computing devices. Typically a processor (e.g., a microprocessor or controller device) will receive instructions from a memory or like storage device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media may include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Transmission Control Protocol, Internet Protocol (TCP/IP), Wi-Fi, Bluetooth, TDMA, CDMA, and 3G.

Where databases are described, it will be understood by one of ordinary skill in the art that (i) alternative database structures to those described may be readily employed, and (ii) other memory structures besides databases may be readily employed. Any schematic illustrations and accompanying descriptions of any sample databases presented herein are illustrative arrangements for stored representations of information. Any number of other arrangements may be employed besides those suggested by the tables shown. Similarly, any illustrated entries of the databases represent exemplary information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes of the present invention. In addition, the databases may, in a known manner, be stored locally or remotely from a device that accesses data in such a database.

For example, as an example alternative to a database structure for storing information, a hierarchical electronic file folder structure may be used. A program may then be used to access the appropriate information in an appropriate file folder in the hierarchy based on a file path named in the program.

It should also be understood that, to the extent that any term recited in the claims is referred to elsewhere in this document in a manner consistent with a single meaning, that is done for the sake of clarity only, and it is not intended that any such term be so restricted, by implication or otherwise, to that single meaning.

In a claim, a limitation of the claim which includes the phrase "means for" or the phrase "step for" means that 35 U.S.C. §112, paragraph 6, applies to that limitation.

In a claim, a limitation of the claim which does not include the phrase "means for" or the phrase "step for" means that 35 U.S.C. §112, paragraph 6 does not apply to that limitation, regardless of whether that limitation recites a function without recitation of structure, material or acts for performing that function. For example, in a claim, the mere use of the phrase "step of" or the phrase "steps of" in referring to one or more steps of the claim or of another claim does not mean that 35 U.S.C. §112, paragraph 6, applies to that step(s).

With respect to a means or a step for performing a specified function in accordance with 35 U.S.C. §112, paragraph 6, the corresponding structure, material or acts described in the specification, and equivalents thereof, may perform additional functions as well as the specified function.

Computers, processors, computing devices and like products are structures that can perform a wide variety of functions. Such products can be operable to perform a specified function by executing one or more programs, such as a program stored in a memory device of that product or in a memory device which that product accesses. Unless expressly specified otherwise, such a program need not be based on any particular algorithm, such as any particular algorithm that might be disclosed in the present application. It is well known to one of ordinary skill in the art that a specified function may be implemented via different algorithms, and any of a number of different algorithms would be a mere design choice for carrying out the specified function.

Therefore, with respect to a means or a step for performing a specified function in accordance with 35 U.S.C. §112, paragraph 6, structure corresponding to a specified function includes any product programmed to perform the specified function. Such structure includes programmed products which perform the function, regardless of whether such product is programmed with (i) a disclosed algorithm for performing the function, (ii) an algorithm that is similar to a disclosed algorithm, or (iii) a different algorithm for performing the function.

CONCLUSION

While various embodiments have been described herein, it should be understood that the scope of the present invention is not limited to the particular embodiments explicitly described. Many other variations and embodiments would be understood by one of ordinary skill in the art upon reading the present description.

What is claimed is:

1. A method, comprising:

(a) for each of a plurality of plays of a wagering game:

(i) randomly generating a symbol combination for said play of the wagering game, the randomly generated symbol combination for said play of the wagering game being independent from the randomly generated symbol combination for each other play of the wagering game; and (ii) determining any award associated with the randomly generated symbol combination for said play of the wagering game;

(b) for each of the plurality of plays of the wagering game, transferring to a tangible medium:

(i) data representing a video presentation of the randomly generated symbol combination for said play of the wagering game; and (ii) data representing any award associated with the randomly generated symbol combination for said play of the wagering game;

(c) causing the tangible medium to be associated with at least one tamper evident item;

(d) enabling the at least one tamper evident item associated with the tangible medium to be inspected for any indication of tampering;

(e) enabling activation of the tangible medium if the tangible medium passes the inspection of the at least one tamper evident item; and (f) after transferring said data to the tangible medium, causing said tangible medium to be available to be purchased.

2. The method of claim 1, which includes, if the tangible medium is activated, enabling redemption of the tangible medium and determining a redemption value for the tangible medium, the determination based on any awards associated with the randomly generated symbol combinations for said plays of the wagering game.

3. The method of claim 1, which includes, prior to causing said tangible medium to be available to be purchased, enabling the tangible medium to be encased in a package, wherein the package comprises at least one of a jewel case and a DVD case.

4. The method of claim 1, wherein the tangible medium comprises a DVD.

* * * * *